US010220239B2

(12) United States Patent
Rau et al.

(10) Patent No.: US 10,220,239 B2
(45) Date of Patent: Mar. 5, 2019

(54) ECCENTRIC WEIGHTLIFTING MACHINE AND ASSOCIATED METHOD OF USE

(71) Applicant: THE CURATORS OF THE UNIVERSITY OF MISSOURI, Columbia, MO (US)

(72) Inventors: Adam Rau, Columbia, MO (US); John Rayburn, Columbia, MO (US); Orr Hadass, Columbia, MO (US); Nicholas Ryan Smith, Plano, TX (US)

(73) Assignee: The Curators of the University of Missouri, Columbia, MO (US)

( * ) Notice: Subject to any disclaimer, the term of this patent is extended or adjusted under 35 U.S.C. 154(b) by 129 days.

(21) Appl. No.: 15/321,394

(22) PCT Filed: Jun. 23, 2015

(86) PCT No.: PCT/US2015/037235
§ 371 (c)(1),
(2) Date: Dec. 22, 2016

(87) PCT Pub. No.: WO2015/200353
PCT Pub. Date: Dec. 30, 2015

(65) Prior Publication Data

US 2017/0197103 A1 Jul. 13, 2017

Related U.S. Application Data

(60) Provisional application No. 62/015,827, filed on Jun. 23, 2014.

(51) Int. Cl.
*A63B 21/00* (2006.01)
*A63B 24/00* (2006.01)
(Continued)

(52) U.S. Cl.
CPC ..... *A63B 21/0624* (2015.10); *A63B 21/0057* (2013.01); *A63B 21/0059* (2015.10);
(Continued)

(58) Field of Classification Search
CPC ..... A63B 21/00058; A63B 21/00061; A63B 21/00065; A63B 21/00069;
(Continued)

(56) References Cited

U.S. PATENT DOCUMENTS 3,387,493 A 6/1968 Strittmatter
4,546,971 A 10/1985 Raasoch
(Continued)

FOREIGN PATENT DOCUMENTS

WO 14041520 A1 3/2014

OTHER PUBLICATIONS

International Search Report for PCT/US2015/037235 dated Sep. 11, 2015.
Written Opinion for PCT/US2015/037235 dated Sep. 11, 2015.

*Primary Examiner* — Gary D Urbiel Goldner
(74) *Attorney, Agent, or Firm* — Thompson Coburn LLP; Kevin M. Kercher

(57) ABSTRACT

An eccentric weightlifting machine that includes a first pole connected to a first weight and to a device acted on by a user, a second pole connected to a second weight and to a motor, wherein the motor lifts the second pole in response to movement of the first pole by the user, and a latch configured to latch the first pole to the second pole during an eccentric exercise portion of a weightlift.

28 Claims, 26 Drawing Sheets

(51) Int. Cl.
*A63B 21/005* (2006.01)
*A63B 21/062* (2006.01)

(52) U.S. Cl.
CPC ..... *A63B 21/063* (2015.10); *A63B 21/0622* (2015.10); *A63B 21/154* (2013.01); *A63B 24/0087* (2013.01); *A63B 2220/80* (2013.01); *A63B 2220/801* (2013.01)

(58) Field of Classification Search
CPC ..... A63B 21/00072; A63B 21/00076; A63B 21/00185; A63B 21/005; A63B 21/0057; A63B 21/0058; A63B 21/157; A63B 21/159; A63B 21/4027; A63B 21/4033; A63B 21/4035; A63B 21/4045; A63B 21/4047; A63B 21/4049; A63B 24/0087; A63B 2220/80; A63B 2220/801; A63B 2220/803; A63B 2220/805; A63B 2220/83; A63B 2220/833; A63B 21/0059; A63B 21/06; A63B 21/062; A63B 21/0622; A63B 21/0624; A63B 21/0626; A63B 21/0628; A63B 21/063; A63B 21/0623; A63B 21/08; A63B 21/15; A63B 21/151; A63B 21/152; A63B 21/154
See application file for complete search history.

(56) References Cited

U.S. PATENT DOCUMENTS 4,628,910 A 12/1986 Krukowski
4,647,039 A * 3/1987 Noffsinger ..... A63B 21/0058 482/130
4,648,594 A * 3/1987 Schleffendorf .... A63B 21/0609 482/102
4,834,365 A * 5/1989 Jones ..... A63B 21/155 482/100
4,898,381 A * 2/1990 Gordon ..... A63B 21/00072 482/103
4,930,770 A * 6/1990 Baker ..... A63B 21/00178 482/132
4,979,733 A * 12/1990 Prud'Hon ..... A63B 21/0058 482/4
4,998,721 A 3/1991 Anders et al.
5,328,429 A * 7/1994 Potash ..... A63B 21/0058 482/4
5,435,798 A 7/1995 Habing et al.
5,476,428 A 12/1995 Potash et al.
5,588,938 A 12/1996 Schneider et al.
5,624,353 A 4/1997 Naidus
5,776,040 A * 7/1998 Webb ..... A63B 21/154 482/98
5,823,921 A 10/1998 Dawson
5,827,154 A 10/1998 Gill
6,095,954 A * 8/2000 Svanberg ..... A63B 21/0628 482/113
6,261,205 B1 * 7/2001 Elefson ..... A63B 21/00181 482/135
6,368,251 B1 4/2002 Casler et al.
6,719,672 B1 4/2004 Ellis et al.
7,044,897 B2 * 5/2006 Myers ..... A63B 21/063 482/138
7,963,886 B1 6/2011 Schwinn et al.
8,360,939 B2 1/2013 Huang
8,900,097 B1 * 12/2014 Griggs ..... A63B 21/4029 482/4
2001/0000782 A1 5/2001 Schiessl
2001/0053734 A1 * 12/2001 Lapcevic ..... A63B 21/0552 482/134
2005/0164853 A1 7/2005 Naidus
2008/0058164 A1 * 3/2008 Douglas ..... A63B 21/0087 482/5
2008/0076643 A1 * 3/2008 Sencil ..... A63B 21/0601 482/97
2009/0270234 A1 10/2009 Alessandri et al.
2011/0172058 A1 * 7/2011 Deaconu ..... A63B 22/0012 482/5
2014/0228174 A1 * 8/2014 Olsen ..... A63B 21/00181 482/5
2014/0274566 A1 * 9/2014 Draper ..... A63B 24/0062 482/8
2014/0287876 A1 * 9/2014 Etter ..... A63B 24/0087 482/5
2015/0148203 A1 * 5/2015 Rios Sodeyama ..... A63B 21/0083 482/112
2016/0151675 A1 * 6/2016 Chazalon ..... A63B 21/0053 482/5

* cited by examiner

ECCENTRIC WEIGHTLIFTING MACHINE AND ASSOCIATED METHOD OF USE

CROSS-REFERENCE TO RELATED APPLICATIONS

The present application is a PCT U.S. National Phase application of PCT/US2015/037235, filed on Jun. 23, 2015, which claims the benefit of U.S. Provisional Patent Application Ser. No. 62/015,827, filed Jun. 23, 2014, which are incorporated herein by reference in their entireties its entirety.

BACKGROUND OF THE INVENTION

This invention relates generally to a weightlifting machine and, more particularly, to a weightlifting machine capable of providing a user with more weight while performing an eccentric muscle exercise than a concentric muscle exercise.

A strength building weightlifting exercise may include both concentric and eccentric muscle contractions. A concentric muscle contraction, or positive contraction, shortens a muscle as it acts against a resistive force, such as a weight. An eccentric muscle contraction, or negative contraction, lengthens a muscle while producing force. For example, during a bicep curl, a user performs a concentric muscle contraction to lift the weight upward and an eccentric muscle contraction while a user slowly lowers the weight back down from the lifted position. Essentially, an eccentric muscle contraction slows the descent of a weight instead of letting gravity completely pull the weight.

Eccentric muscle contractions generate more force than concentric muscle contractions. In addition, users can build greater strength by including eccentric muscle contraction exercises into a workout. Because of these two factors, users looking to quickly and effectively add strength may focus their workout around eccentric muscle contraction exercises.

Negative training focuses on eccentric exercises during a weightlifting workout. Negative training involves the use of heavier weights, which a user may not actually be able to lift concentrically, and the user exercises by only performing eccentric exercises.

Negative training using free weights is not without downsides. For example, negative training merely using free weights poses a higher risk for injury because heavier weights may be used. In addition, in many negative training exercises using free weights, a user needs a spotter to assist them while they exercise. The spotter helps the user move the heavy weights to a position where the eccentric exercise begins. For example, in the bicep curl example, the spotter assists the user to lift the heavy weights to the curled position, and then spot the user as the user slowly lowers the weights downward.

Negative training poses issues for users using conventional weightlifting machines. Generally, weightlifting machines require a user to select an amount of weight to lift prior to beginning an exercise. Conventional exercise equipment includes only one weight selection, so the amount a user selects is the amount of weight the user lifts during both the concentric and eccentric phases. A spotter could be used like the free weight example above to perform negative training, but people frequently use conventional exercise equipment for the very purpose of exercising alone without fear of injury.

The present invention is directed to overcoming one or more of the problems set forth above.

SUMMARY OF INVENTION

The present invention is directed to a weightlifting machine that allows a user to lift a first set of weights in a weight stack during a concentric lift and the first set of weights in addition to a second set of weights in the weight stack during an eccentric lift. The weightlifting machine according to the exemplary embodiments includes a motor that lifts the second set of weights. After the user finishes his concentric lift, the motor releases the second set of weights to the user, and the user performs an eccentric lift by lowering the combined weight of the first and second set of weights.

In an aspect of the invention, an eccentric weightlifting machine is disclosed. The eccentric weightlifting machine includes a first pole connected to a first set of weights in a weight stack and to a device acted on by a user, a second pole connected to a second set of weights in the weight stack and to a motor, wherein the motor lifts the second pole in response to movement of the first pole by the user, and a latch configured to latch the first pole to the second pole during an eccentric exercise portion of a weightlift.

In another aspect of this invention, an eccentric weightlifting machine includes a first pole connected to a first weight stack and a device acted on by a user; a second pole connected to a second weight stack and a motor, wherein the motor lifts the second pole in response to movement of the first pole by the user; and a latch configured to latch the first pole to the second pole during the eccentric exercise portion of a weightlift.

In yet another aspect of this invention, a method of operating a weightlifting machine is disclosed. The method includes receiving a signal indicative of movement by a first pole from a first sensor, sending a command to a motor to lift a second pole connected to the motor, receiving a signal indicative of contact between the first sensor and the second pole, sending a command to the motor to cease lifting of the second pole in response to the signal from the first sensor indicative of contact between the first sensor and the second pole, receiving a signal from a second sensor indicative of the first pole latching to the second pole, and sending a command to the motor to release a clutch within the motor.

In still another aspect of this invention, a weightlifting machine is disclosed. The weightlifting machine provides a user with a first amount of weight during a concentric lift and a second amount of weight during an eccentric lift, whereby the second amount of weight is the first amount of weight plus additional weight.

In still yet another aspect of the present invention, a method of operating a weightlifting machine is disclosed. This method includes receiving a first signal from a first sensor, the first signal being indicative of movement of a first pole, sending a first command to a motor to lift a second pole, the second pole being connected to the motor, the first command being sent in response to the first signal, receiving a second signal from the first sensor, the second signal being indicative that the first pole is stationary, sending a second command to the motor to cease lifting the second pole, the second command being sent in response to the second signal, receiving a third signal from a second sensor indicating that the second pole is latched to the first pole, and sending a third command to the motor to release a clutch within the motor or run the motor in reverse, the third command being sent in response to the third signal.

These are merely some of the innumerable aspects of the present invention and should not be deemed an all-inclusive listing of the aspects associated with the present invention. These and other aspects will become apparent to those skilled in the art in light of the following disclosure and accompanying drawings.

BRIEF DESCRIPTION OF THE DRAWINGS

For a better understanding of the present invention, reference may be made to the accompanying drawings in which.

Figure 1:
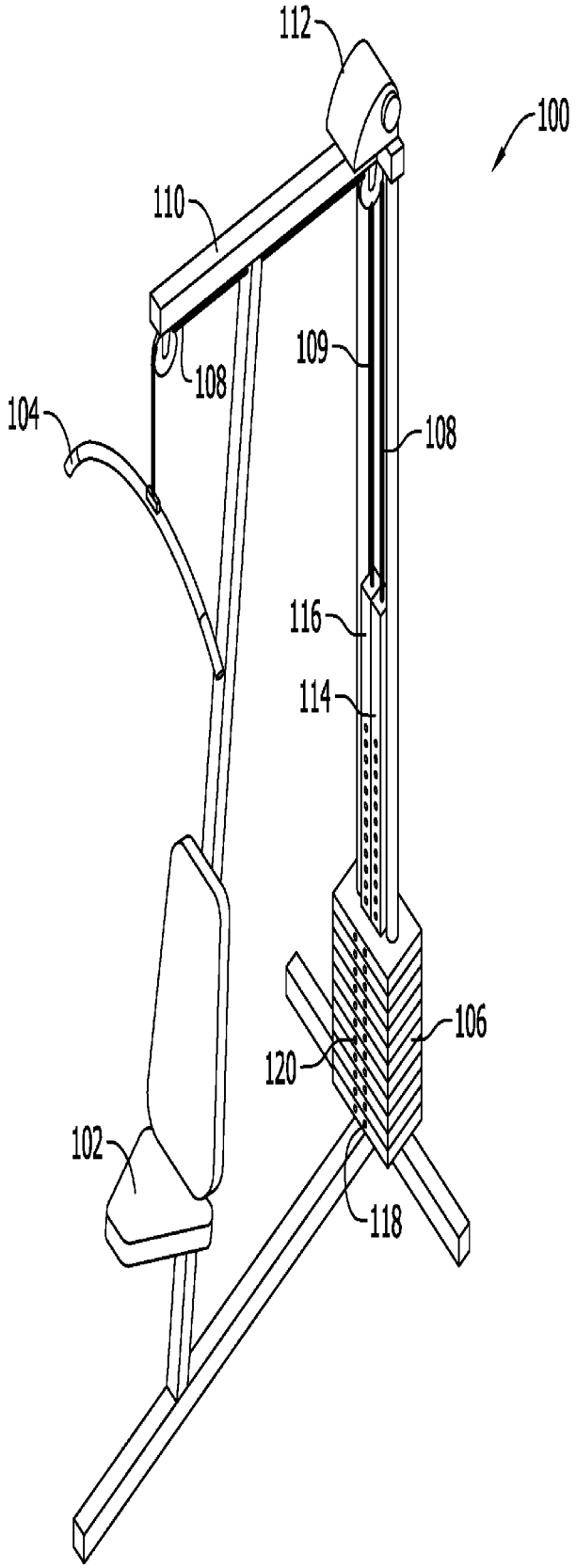
FIG. 1 illustrates an eccentric weightlifting exercise machine according to an exemplary embodiment.

Reference characters in the written specification indicate corresponding items shown throughout the drawing figures.

DETAILED DESCRIPTION

In the following detailed description, numerous specific details are set forth in order to provide a thorough understanding of the invention. However, it will be understood by those skilled in the art that the present invention may be practiced without these specific details. In other instances, well-known methods, procedures, and components have not been described in detail so as not to obscure the present invention.

Referring to the accompanying drawings in which like reference numbers indicate like elements, FIG. 1 illustrates the eccentric weightlifting machine according to an exemplary embodiment that is generally indicated by numeral 100. The eccentric weightlifting machine 100 may have a seat 102, a bar 104, and a weight stack 106. FIG. 1 illustrates an eccentric weightlifting machine 100 where the bar 104 connects to the weight stack 106 through a first cable 108 over a frame 110, however, the embodiments shown herein are not limited to a weightlifting machine having this configuration. The exemplary embodiments described herein may be applied to any weightlifting machine having a vertical weight stack 106. The bar 104 may be a handle, a strap, a rope, or bar with a cushion, any other device that allows the user to lift the weight stack 106. In some embodiments, the seat 102 may be omitted or removable.

In addition to the conventional components recited above, the eccentric weightlifting machine 100 includes a motor 112, and two weightlifting poles, i.e., a user pole 114 and a motor pole 116. The user pole 114 connects to the bar 104 through the first cable 108 such that, when a user pulls on the bar 104 with sufficient force, the user pole 114 rises. The user pole 114 may connect to the weight stack 106 through a first pin 118. The first pin 118 may extend through a hole within one of the weights in the weight stack 106 or in a hole between weights in the weight stack 106. The user chooses an amount of weight to concentrically lift when placing the first pin 118 in the weight stack 106 and user pole 114. Alternatively, the user may choose to concentrically lift no weight by not placing the first pin 118 in the user pole 114. The motor pole 116 connects to the motor 112 through a second cable 109 such that, when the motor 112 activates, the motor pole 116 rises. The motor pole 116 connects to the weight stack 106 through a second pin 120 in a similar way as the first pin 118. As shown in FIG. 1, the weight stack 106 includes two sets of holes corresponding to the two poles, i.e., a user pole 114 and a motor pole 116. Preferably, the second pin 120 is inserted into the weight stack 106 at a position lower than the first pin 118 so that the motor 112 lifts weights from the weight stack 106 in addition to the weights from the weight stack 106 lifted by the user using the bar 104. For illustration purposes only in FIG. 1, the first pin 118 is placed between the fourth and fifth weights in the weight stack 106, which may equate the forty pounds, and the second pin 120 is placed between the eighth and ninth weights in the weight stack, which may equate to another forty pounds, or eighty pounds in total. According to FIG. 1 and through the exemplary embodiments described herein for illustration purposes, the user may concentrically lift forty pounds while the motor may lift another forty pounds, and after the concentric lift, the user may eccentrically "lift" (i.e., lower) eighty pounds in total.

The motor 112 may be any electric motor. An illustrative, but nonlimiting, example includes a 12 volt DC motor, a TRAC® Outdoor Big Water 45. Anchor Winch T10110™ manufactured by Trac Outdoor Products Company, having a place of business at 6039 Dana Way, Antioch, Tennesse 37013. This can also include an AC motor, or any other type of electric motor. Moreover, any source of weight transfer may suffice such as hydraulics, gas motors, linear induction, and so forth.

The motor 112 includes a gearing mechanism and a clutch that allows movement only in one direction (e.g., in the movement that lifts the motor pole 116 upward) while the clutch is active. The clutch and gears may prevent the motor pole 116 from dropping due to gravity while the clutch is engaged. When the clutch is disengaged, the motor 112 may allow the motor pole 116 to drop. As shown in FIG. 1, the motor 112 may be located on the top of the eccentric weightlifting machine's frame 110.

Figure 2:
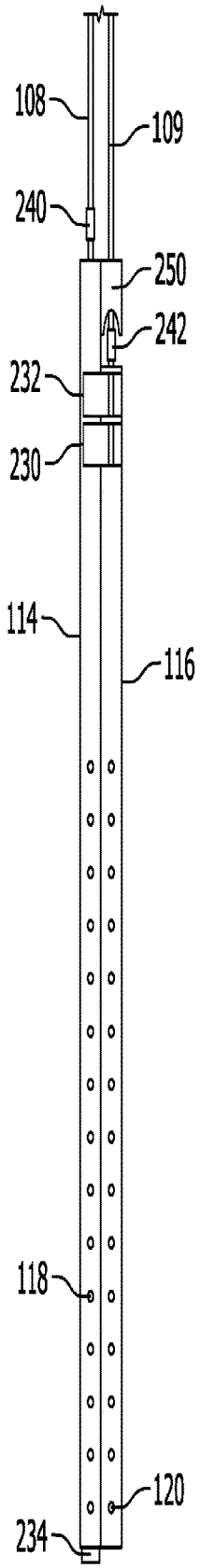
FIG. 2 illustrates a rear elevational view of a first weightlifting pole and a second weightlifting pole of the eccentric weightlifting machine according to an exemplary embodiment.

Referring to FIG. 2, the user pole 114 is adjacent to the motor pole 116. A first sensor 230, a second sensor 232, and a third sensor 234 may be mounted on the user pole 114. The first sensor 230 and second sensor 232 may be mounted anywhere on the user pole 114 above the holes where the pin 118 or 120 is inserted, such as in between the user pole 114 and the motor pole 116. The first sensor 230 is mounted below the second sensor 232 but located near the second sensor 232, e.g., one to four inches away. The third sensor 234 is preferably mounted on the bottom of the user pole 114. The first sensor 230 may detect when the motor pole 116 touches the first sensor 230 during the concentric lift portion. The second sensor 232 may detect when the second sensor 232 touches the motor pole 116, which signifies that the user is lowering the user pole 114, thereby indicating that the user has begun the eccentric phase of the exercise. Moreover, the third sensor 234 may detect when the third sensor 234 is touching the eccentric weightlifting machine's frame 110, which signifies that the user is not exerting any or enough force to lift the user pole 114. In other words, the third sensor 234 detects when the eccentric weightlifting machine 100 is being used. The first sensor 230, second sensor 232, and third sensor 234 may be contact sensors, roller level micro-switches, piezoelectric sensors, or any type of sensors configured to detect contact with either the frame 110 or the motor pole 116.

The user pole 114 and the motor pole 116 each include a first connection device 242 and a second connection device 240, respectively, connecting the user pole 114 and the motor pole 116 to one of the first cable 108 or the second cable 109. For example, the connection devices 240, 242 may be eye bolts, but any means of connecting a pole to a cable or the like may be used in the exemplary embodiments. A cable is described for illustration purposes only as connecting the bar 104 and the user pole 114 or the motor 112 and the motor pole 116, but any mechanical connection between either the motor pole 116 and the motor 112 or the user pole 114 and the bar 104 may connect two components.

As shown in FIG. 2, the user pole 114 is longer than the motor pole 116. This difference in length accommodates a latch 250 mounted on the user pole 114. The latch 250 locks the user pole 114 and the motor pole 116 together while the two poles 114, 116 are being lowered during an eccentric lift. The latch 250 may be for example a gate latch or a gravity latch.

Figure 3A:
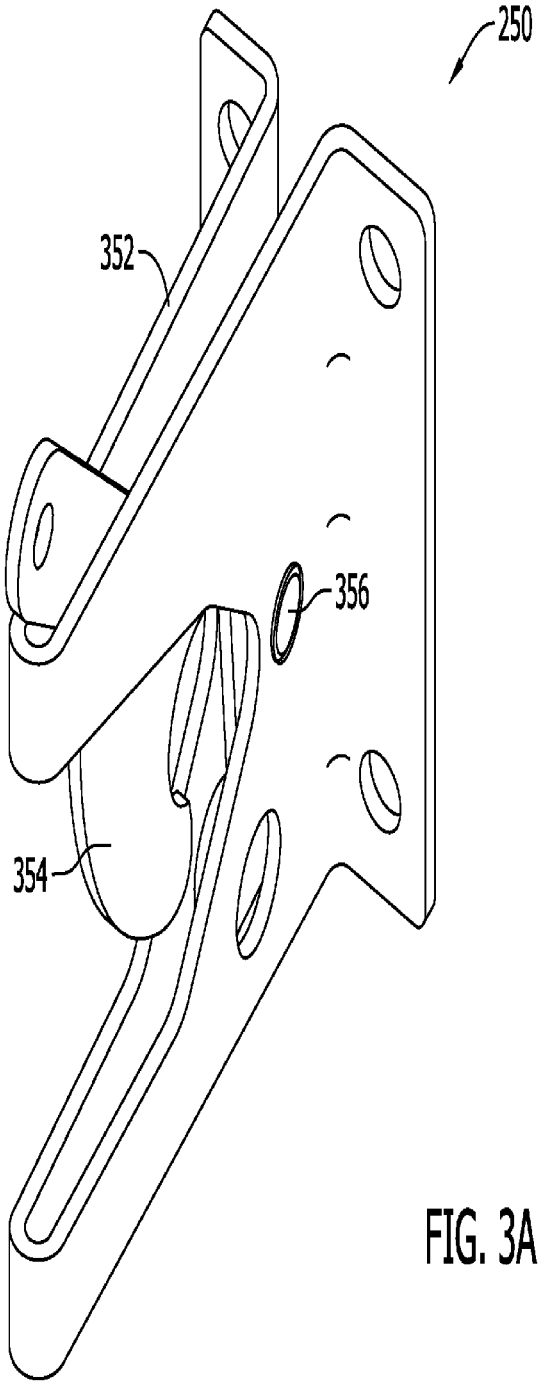
FIG. 3*a* illustrates a latch mounted on the first weightlifting pole according to an exemplary embodiment.

An example of the latch is illustrated in FIG. 3*a* and generally indicated by numeral 250. As shown in FIG. 3*a*, the gate or gravity latch 250 includes three main components, a mount 352, a hinge 356, and a hook 354. The mount 352 remains stationary. The hook 354 may rotate relative to the mount 352 about the hinge 356. When the hook 354 is in its down position, like it is shown in FIG. 3*a*, the hook 354 latches any structure caught between the hook 354 and the mount 352. Gate latches like that shown in FIG. 3*a* are well-known in the art.

The latch 250 may receive and latch the first connection device 242 to lock the user pole 114 to the motor pole 116. By locking the user pole 114 and the motor pole 116 together, the user is able to perform an eccentric lift exercise using the additional weight carried by the motor pole 116. The latch 250 may be positioned in such a way that when both the motor pole 116 and the user pole 114 are resting, i.e., no force applied by a user or the motor 112, the first connection device 242 does not extend high enough to lock within the latch 250. Thus, latching only occurs during an eccentric phase of a weightlift because the user pole 114 is lowered relative to the motor pole 116.

Figure 3B:
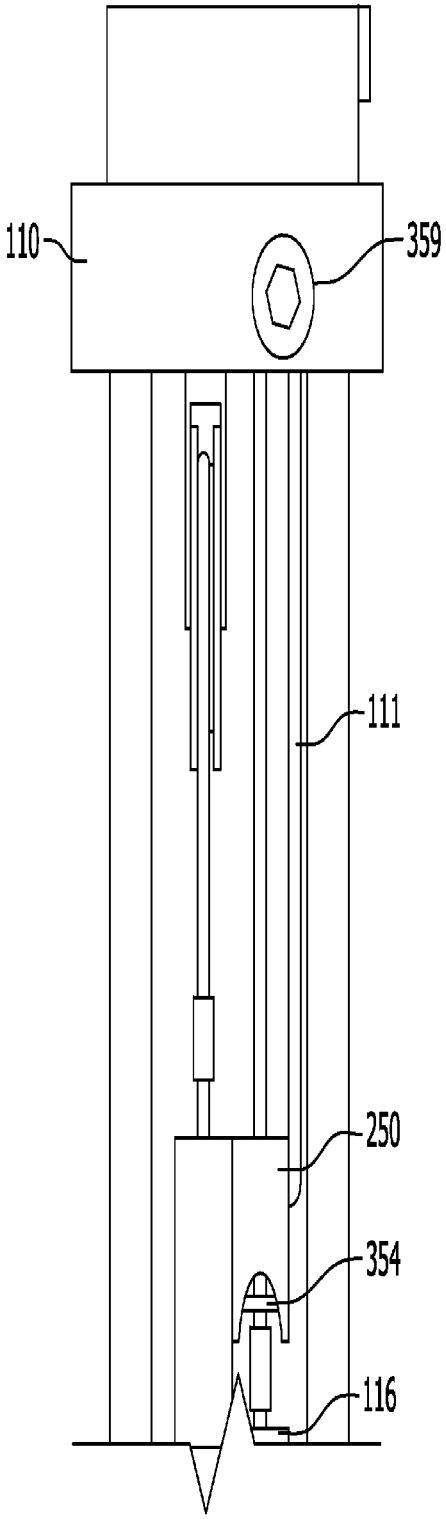
FIG. 3*b* illustrates a third cable mounted between the frame and a hook on a latch according to an exemplary embodiment.

As shown in FIG. 3*b*, the hook 354 is connected to a third cable 111 that is also connected to the frame 110 and preferably at the top of the frame 110. The third cable 111 connects to the frame 110 through a connection means 359, such as a screw, nail, or bolt. The third cable 111 has a finite length, and the third cable 111 serves to unlatch the latch 250 when the motor pole 116 is lowered completely or substantially completely lowered.

In other words, the third cable 111 is connected to the latch 250 that can pull the hook 354 when the third cable 111 becomes taut. This will unlatch the latch 250 at the end of the eccentric exercise so that the user pole 114 is no longer locked together with the motor pole 116 during the concentric phase of a subsequent lifting repetition. During a lifting repetition, the latch 250 latches to the motor pole 116 when an eccentric phase of the repetition begins, and the latch 250 unlatches when the first cable 108 pulls the hook 354 when the eccentric phase of the repetition ends. The length of the third cable 111 is predetermined to unlatch the latch 250 when the weight stack 106 is lowered or substantially lowered and preferably the weight stack is located at the bottom of the eccentric weightlifting machine 100. While a third cable 111 pulling open the latch 250 has been described for illustration purposes, other ways of opening the latch 250 may be used, such as electromagnetism, or using a switch.

Figure 4:
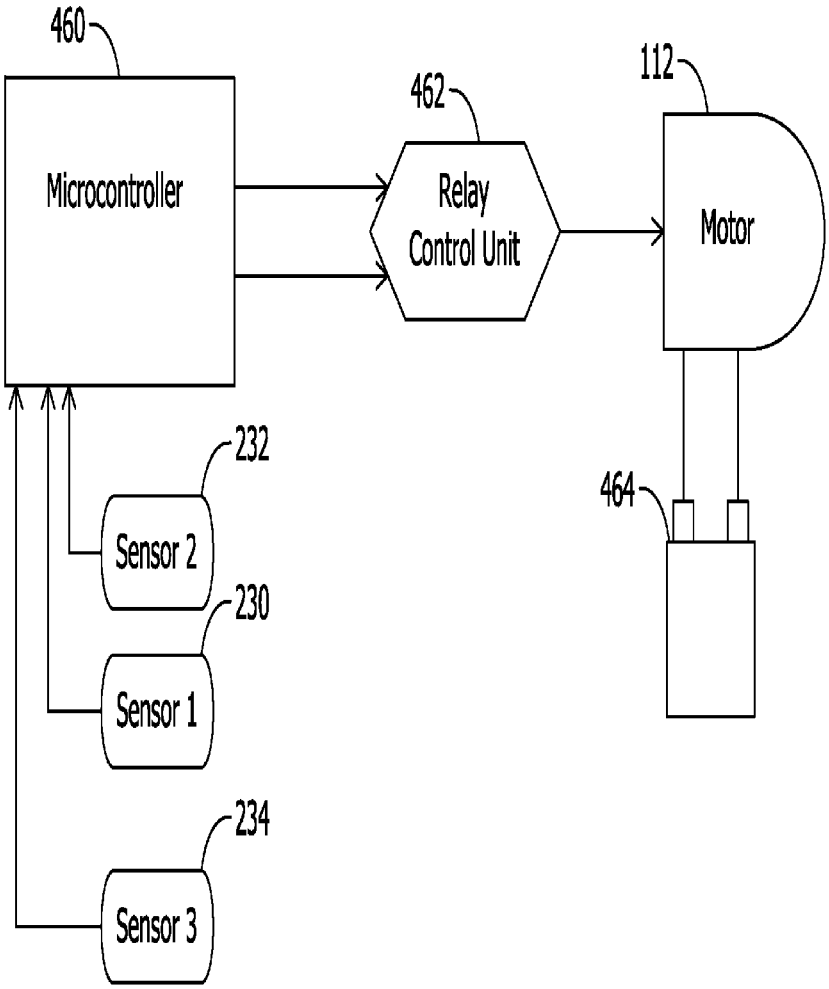
FIG. 4 illustrates a block diagram of the electronic components of the eccentric weightlifting machine according to an exemplary embodiment.
Figure 5A:
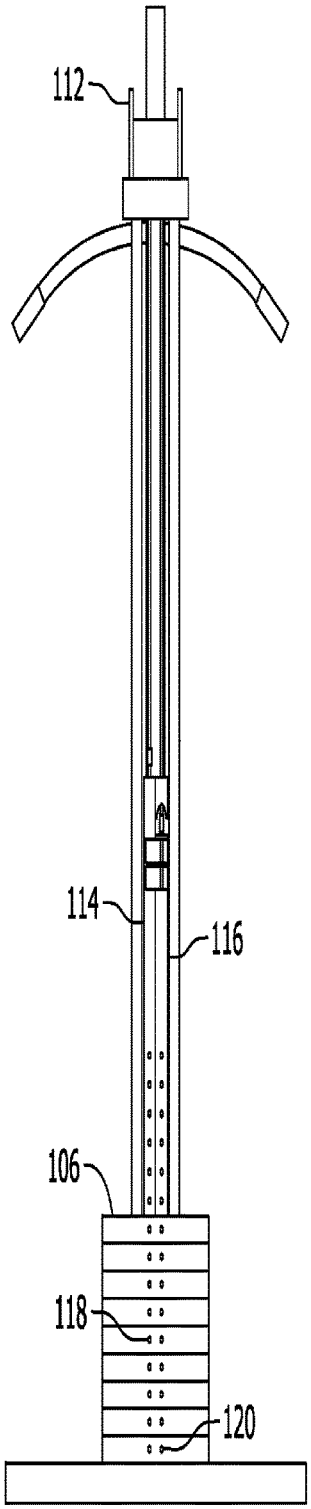
FIGS. 5-9 illustrates the function of the eccentric weightlifting machine during all phases of a lifting sequence according to an exemplary embodiment.
Figure 5B:
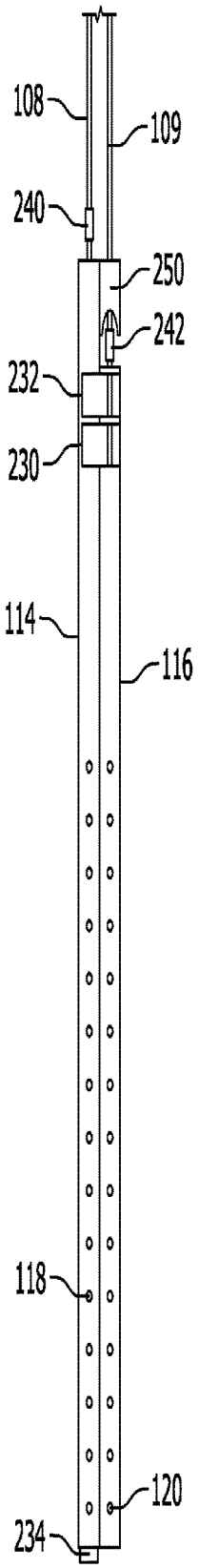

FIG. 4 illustrates the electrical configuration of the eccentric weightlifting machine 100. The eccentric weightlifting machine 100 includes a microcontroller 460, the first, second, and third sensors 230, 232, 234, a relay control unit 462, the motor 112, and a power supply 464.

The microcontroller 460 is connected to the three sensors 230, 232, 234 and the relay control unit 462. The microcontroller 460 receives signals from the three sensors 230, 232, 234 and interprets the signals in order to control the motor 112. The microcontroller 460 may be located anywhere on the eccentric weightlifting machine 100. For example, the microcontroller 460, the relay control unit 462, and the power supply 464 may all reside in a black box located near the motor 112. The microcontroller 460 may include software or configurable hardware that receives the sensor signals and outputs signals to the relay control unit 462 after interpreting the sensor signals.

As described above, the third sensor 234 indicates whether the user is exerting any force on the user pole 114. The microcontroller 460 uses the signals from the third sensor 234 to decide whether to activate the motor 112. When the third sensor 234 sends a signal to the microcontroller 460 indicating that it is no longer in contact with the frame 110, the microcontroller 460 sends a signal to the relay control unit 462 to instruct the motor 112 to begin lifting the motor pole 116.

The microcontroller 460 uses the signals from the first sensor 230 to decide whether to deactivate the motor 112. When the first sensor 230 sends a signal to the microcontroller 460 indicating that it is contacting with the motor pole 116, the microcontroller 460 sends a signal to the relay control unit 462 to instruct the motor 112 to stop lifting the motor pole 116. Whenever the microcontroller 460 receives a signal from the first sensor 230 indicating that it is not in contact with the motor pole 116, and the microcontroller 460 receives a signal from the third sensor 234 that it is not in contact with the frame 110, the microcontroller 460 instructs the motor 112 to engage the clutch (if previously disengaged) and lift the motor pole 116.

The microcontroller 460 uses the signals from the second sensor 232 to decide whether to disengage the clutch. When the second sensor 232 sends a signal to the microcontroller 460 indicating that the second sensor 232 is contacting the motor pole 116 and the eccentric phase has begun, the microcontroller 460 sends a signal to the relay control unit 462 to instruct the motor 112 to disengage the clutch so that the user may lower both the user pole 114 and the motor pole 116. The microcontroller 460 also uses the signals from the second sensor 232 to determine when the eccentric phase is over. While the latch 250 locks the motor pole 116 to the user pole 114, the second sensor 232 remains in contact with the motor pole 116. Only after the latch 250 becomes unlatched does the second sensor 232 break contact with the motor pole 116. Thus, the microcontroller 460 uses the signal from the second sensor 232 to determine when the eccentric phase begins and ends.

The relay control unit 462 converts the digital signals sent from the microcontroller 460 into analog signals understood by the motor 112.

The power supply 464 is connected to the motor 112 to power the motor 112. Although not illustrated, the power supply 464 may also provide electrical power to the relay control unit 462 and the microcontroller 460. The power supply 464 may be either a DC power source, such as a battery, or AC power source, such as a wall outlet, or a combination of the two. The power supply 464 may further include an AC to DC converter, if necessary. Any of a wide variety of computers and processors may be utilized for the microcontroller 460. Moreover, any of a wide variety of input/output devices may be utilized for the relay control unit 462 and may be incorporated in the microcontroller 460 rather than being a separate physical item.

FIGS. 5-9 illustrate the various phases of a weightlift and how the eccentric weightlifting machine functions during each phase. During an initial phase illustrated in FIGS. 5*a* and 5*b*, the user may position the first pin 118 in the weight stack 106. In the example shown in FIGS. 5*a* and 5*b*, the user has inserted the first pin 118 between the fourth and fifth weights in the weight stack 106 (forty pounds) and the second pin 120 between the eighth and ninth weights in the weight stack 106 (an additional forty pounds). Because the user pole 114, which is connected to forty pounds, is connected to the bar 104, the user will concentrically lift forty pounds, and the motor 112 will lift the additional 40 pounds connected to the motor pole 116 while the user applies concentric force to the bar 104.

Figure 6A:
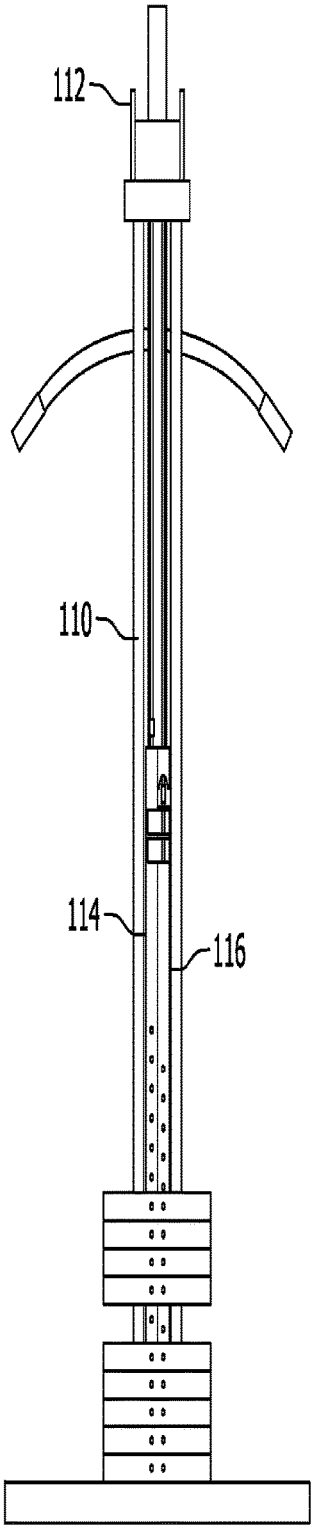
Figure 6B:
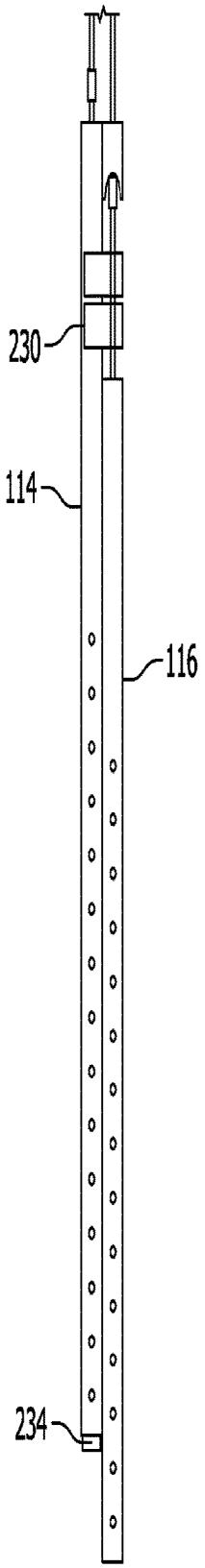
Figure 7A:
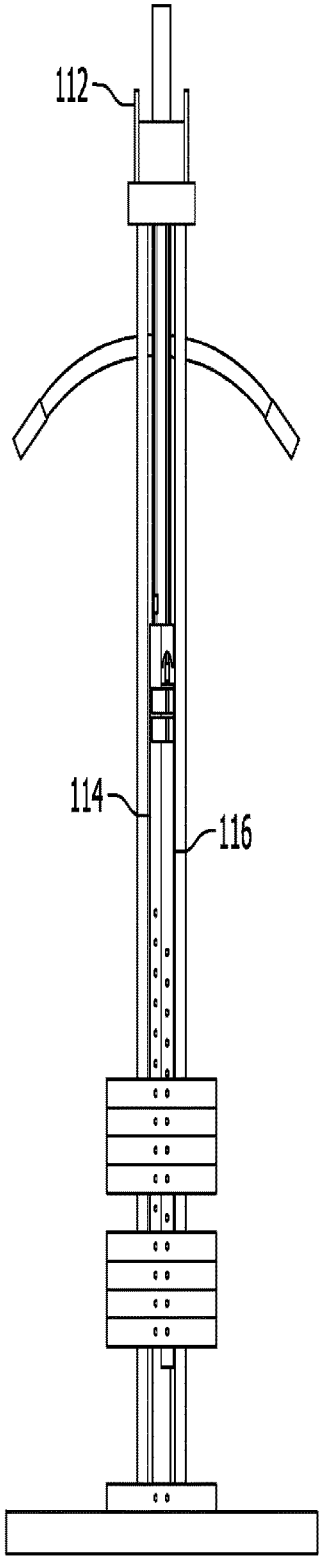
Figure 7B:
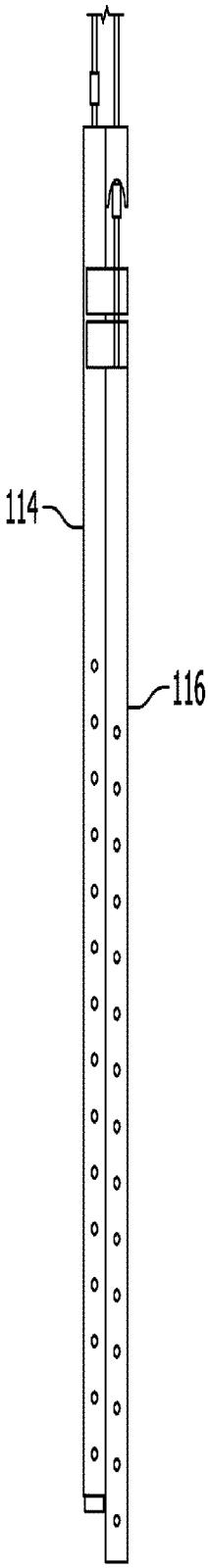

Referring now to FIGS. 6*a* and 6*b* as well as the electronics in FIG. 4, while the user concentrically lifts the weight connected to the user pole 114, the motor 112 pulls up the motor pole 116 in response to a signal from the third sensor 234. When the third sensor 234 detects that it is no longer in contact with the frame 110 due to the user lifting the user pole 114, the third sensor 234 sends a signal to a microcontroller 460, and the microcontroller 460 interprets the message and instructs the motor 112 to begin lifting the motor pole 116. The motor 112 continues to lift the motor pole 116 until the motor pole 116 contacts the first sensor 230 as shown in FIGS. 7*a* and 7*b* as well as FIG. 4. If the microcontroller 460 later detects that the first sensor 230 is no longer touching the motor pole 116 and the third sensor 234 is not touching the frame 110 and the microcontroller 460 has not received a signal from the second sensor 232 (for example if the user lifted the user pole 114, stopped, and continued concentrically lifting), the microcontroller 460 again instructs the motor 112 to continue lifting the motor pole 116 until the microcontroller 460 receives a signal from the first sensor 230.

Figure 8A:
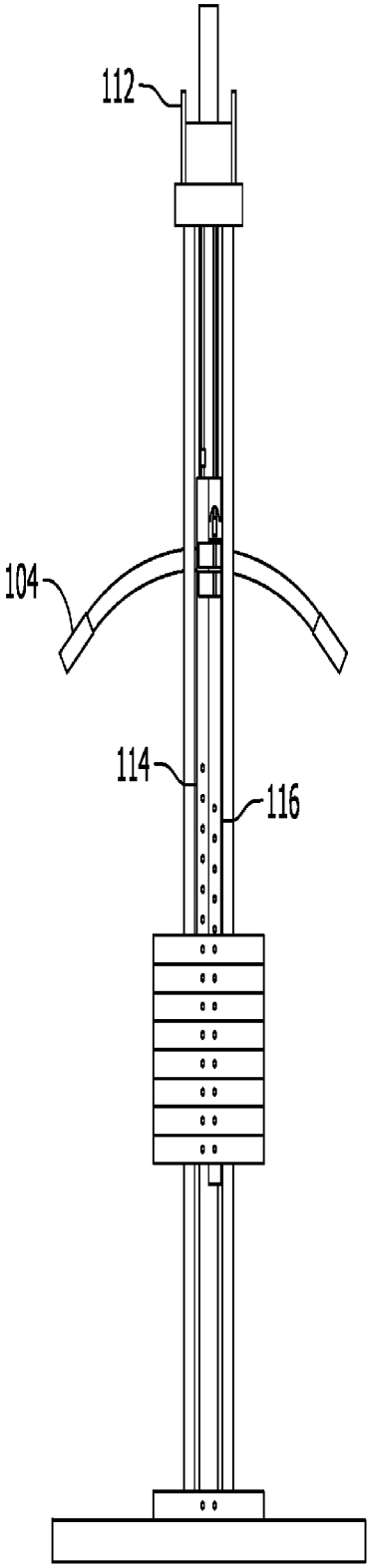
Figure 8B:
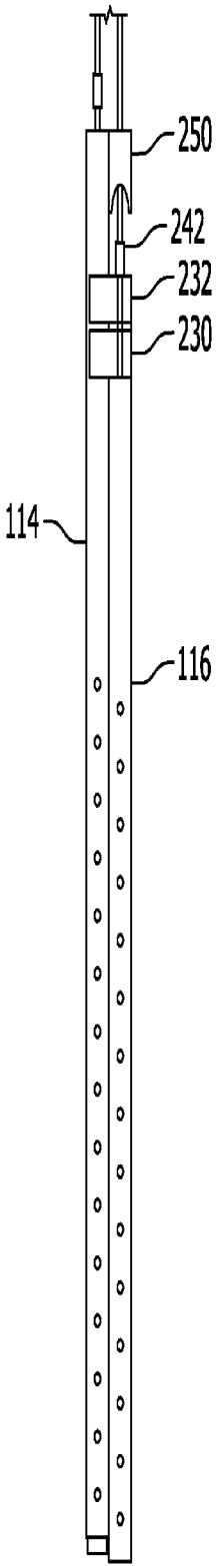

Referring now to FIGS. 8*a* and 8*b* as well as the latch 250 in FIG. 3*a*, after the user completes the concentric lift, the user begins the eccentric lift and begins to lower the bar 104. As the user allows the bar 104 to go back up, the user pole 114 begins to lower. As the user pole 114 lowers, the latch 250 also lowers toward the first connection device 242 on the motor pole 116. The latch 250 includes a hook 354, preferably but not necessarily rounded, that moves about the hinge 356 when contacted by the first connection device 242 to allow the first connection device 242 on the motor pole 116 to move the hook 354 and enter the latch 250. Once the first connection device 242 moves out of the way of the hook 354, gravity pulls the hook 354 downward to latch the first connection device 242 within the latch 250. By latching the user pole 114 to the motor pole 116, the user bears all eighty pounds. Thus, the user eccentrically lifts more weight than during the concentric lift. While the latching has been described as happening while the user lowers the user pole 114, the latching may occur earlier, such as when the motor 112 brings the motor pole 116 up to touch the first sensor 230.

In addition, as the user pole 114 lowers, the second sensor 232 contacts the motor pole 116. The microcontroller 460 uses the signal from the second sensor 232 to identify when the eccentric portion of the lift begins. Upon receiving the signal from the second sensor 232, the microcontroller 460 instructs the motor 112 to release the clutch so that the weight connected with the motor pole 116 may lower.

Figure 9A:
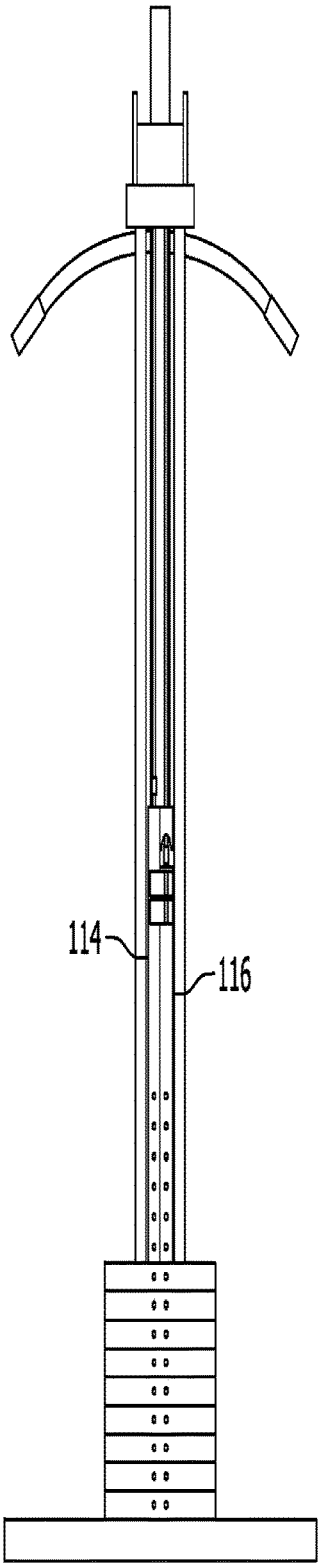
Figure 9B:
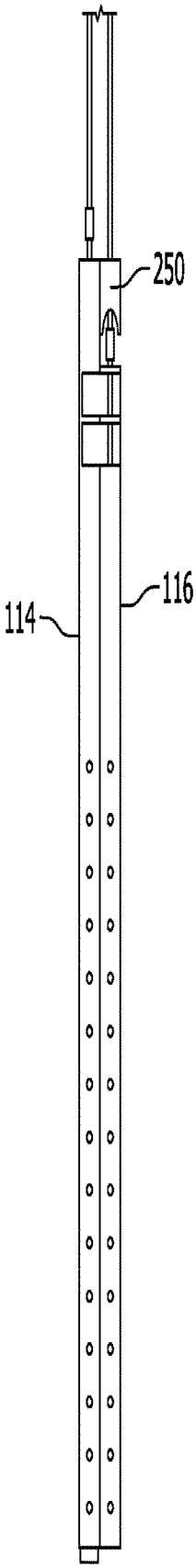

The microcontroller 460 continues to receive a signal from the second sensor 232 that it is contacting the motor pole 116 until the motor pole 116 is brought down far enough that the latch 250 is unlatched, such as by a taut third cable 111 tugging on the hook 354. Referring to FIGS. 9*a* and 9*b*, the weight stack 106 is brought down to the original position or nearly to the original position and the latch 250 unlatches to once again separate the user pole 114 from the motor pole 116. The user may either finish the set or begin another repetition. If the user begins another repetition, the user will again concentrically lift less weight, e.g., forty (40) pounds.

Figure 10:
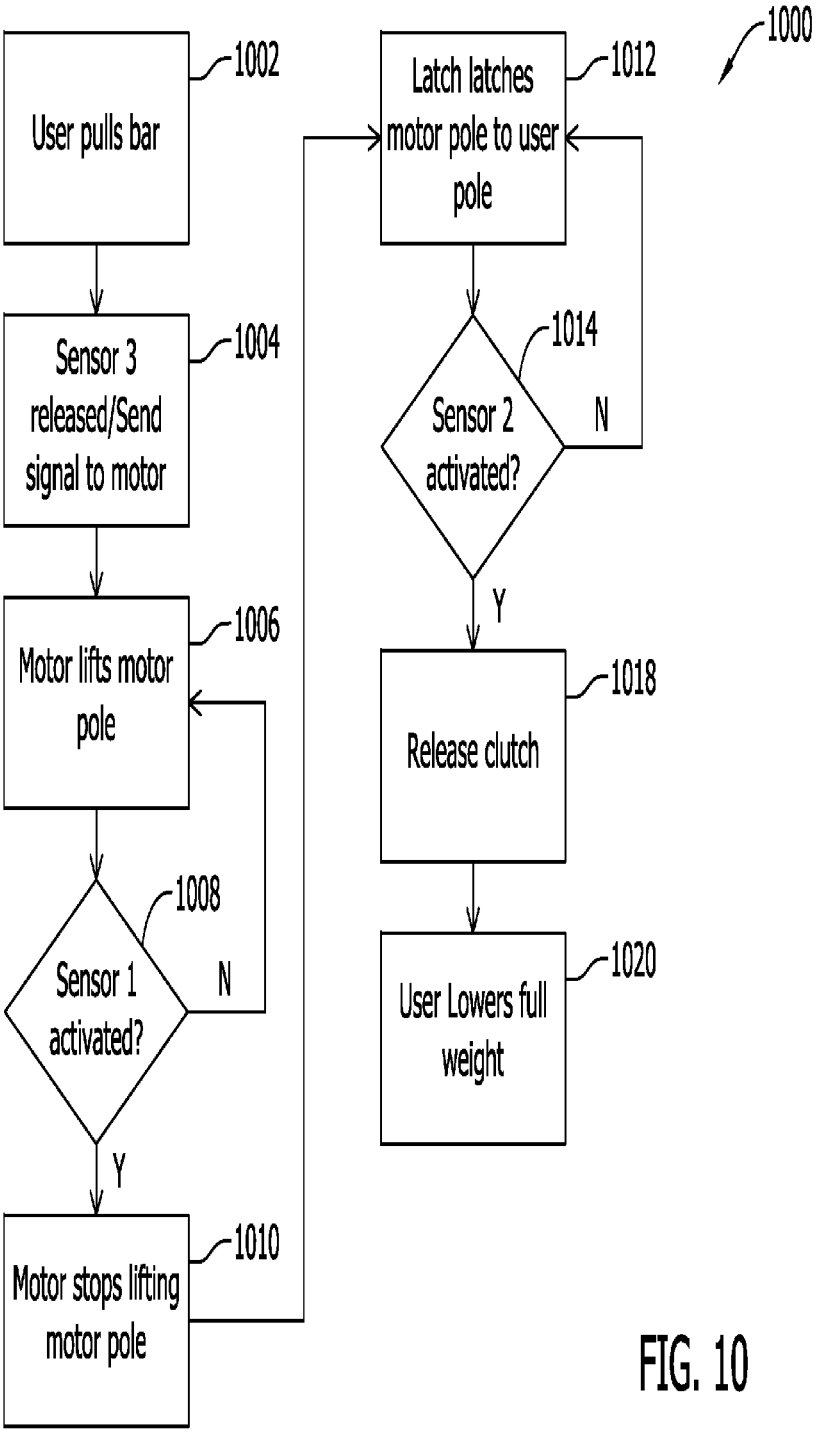
FIG. 10 illustrates a block diagram for the method of the eccentric weightlifting machine according to an exemplary embodiment.

FIG. 10 illustrates a method 1000 for how the eccentric weightlifting machine 100 operates. In the description of the flowcharts, the functional explanation marked with numerals in angle braces, <nnn>, will refer to the flowchart blocks bearing that number.

In step <1002>, a user pulls the bar 104 to begin the concentric phase of the lift. In response to the user pulling the bar 104, the user pole 114 begins to rise. When the user pole 114 rises, the third sensor 234 loses contact with the frame 110, and the third sensor 234 sends a signal to the microcontroller 460 indicating that it is no longer contacting the frame 110 in step <1004>. Upon receiving this signal from third sensor 234, the microcontroller 460 instructs the motor 112 to begin lifting the motor pole 116 in step <1006>. The microcontroller 460 subsequently determines if the first sensor 230 is activated in step <1008>, and the microcontroller 460 continues to instruct the motor 112 to lift the motor pole 116 until the first sensor 230 touches the motor pole 116. The motor 112 may lift the motor pole 116 at a quick but not rapid pace. A user may configure the motor 112 to lift slower or faster based on his typical lifting speeds.

When the first sensor 230 touches the motor pole 116, the microcontroller 460 commands the motor 112 to stop lifting the motor pole 116 in step <1010>. Subsequently, the latch 250 latches the motor pole 116 to the user pole 114 in step <1012>. The microcontroller 460 determines whether the motor pole 116 contacted the second sensor 232 in step <1014>. If the second sensor 232 is not in contact with the motor pole 116, the microcontroller 460 continues to wait until the second sensor 232 sends a signal, and the clutch of the motor 112 holds the weight. If the second sensor 232 is in contact with the motor pole 116, the microcontroller 460 commands the motor 112 to release the clutch in step <1018> to allow the user to eccentrically lower the weight connected to the user pole 114 and the motor pole 116 in step <1020>.

Figure 11:
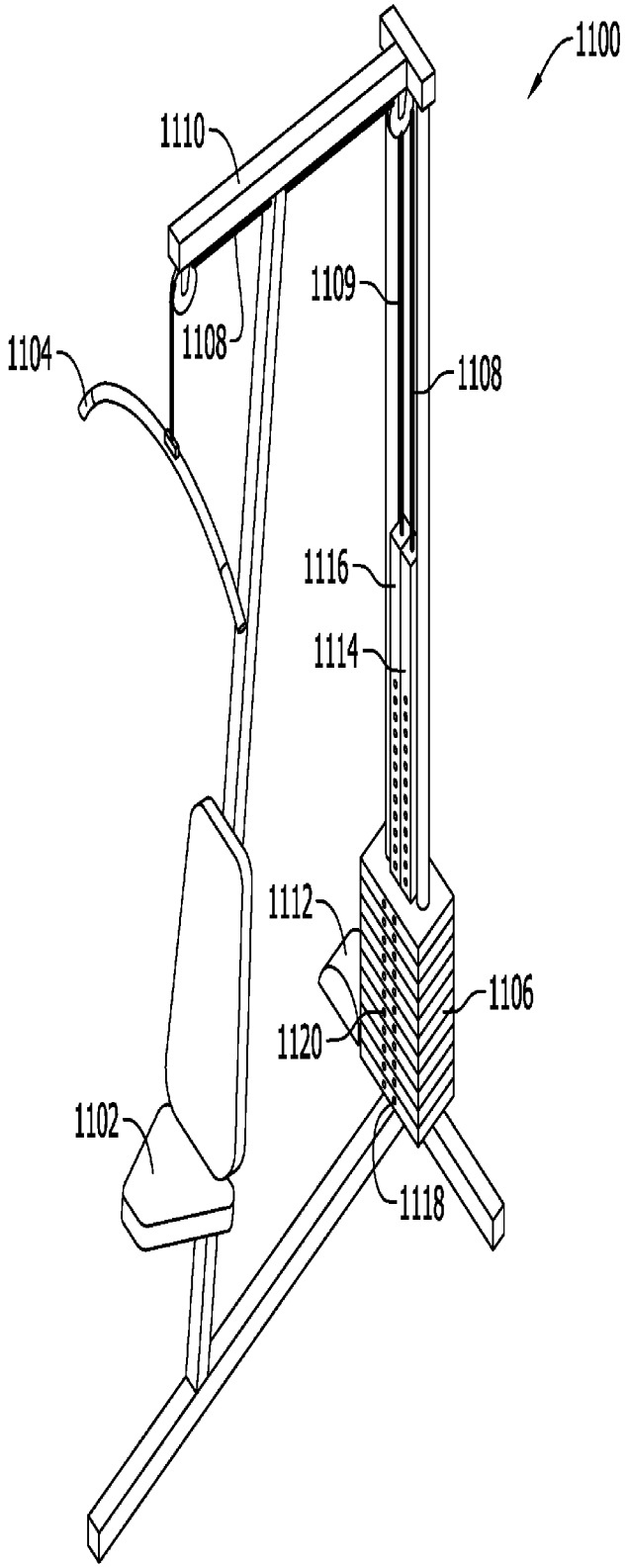
FIG. 11 illustrates an eccentric weightlifting exercise machine according to another exemplary embodiment.

Referring to FIG. 11, an eccentric weightlifting machine according to a second embodiment 1100, may have a seat 1102, a bar 1104, and a weight stack 1106. FIG. 11 illustrates that the bar 1104 connects to the weight stack 1106 through a first cable 1108 over a frame 1110; however, the embodiments shown herein are not limited to a weightlifting machine having this configuration.

In addition to the conventional components recited above, the eccentric weightlifting machine 1100 includes a motor 1112 and two weightlifting poles, i.e., a user pole 1114 and a motor pole 1116. The user pole 1114 connects to the bar 1104 through the first cable 1108 such that, when a user pulls on the bar 1104 with sufficient force, the user pole 1114 rises. The user pole 1114 may connect to the weight stack 1106 through a first pin 1118. The user chooses an amount of weight to concentrically lift when placing the first pin 1118 in the weight stack 1106 and user pole 1114. The motor pole 1116 connects to the motor 1112 through a second cable 1109 such that, when the motor 1112 activates, the motor pole 1116 rises. The motor pole 1116 connects to the weight stack 1106 through a second pin 1120 in a similar way as the first pin 1118. As shown in FIG. 11, the weight stack 1106 includes two sets of holes corresponding to the two poles, i.e., a user pole 1114 and a motor pole 1116. Preferably, the second pin 1120 is inserted into the weight stack 1106 at a position lower than the first pin 1118 so that the motor 1112 lifts weights from the weight stack 1106 in addition to the weights from the weight stack 1106 lifted by the user using the user bar 1104. For illustration purposes in FIG. 11, the first pin 1118 is placed between the fourth and fifth weights in the weight stack 1106, which may equate the forty pounds, and the second pin 1120 is placed between the eighth and ninth weights in the weight stack, which may equate to another forty pounds, or eighty pounds in total. According to FIG. 11 and through the exemplary embodiments described herein for illustration purposes, the user may concentrically lift forty pounds while the motor may lift another forty pounds, and after the concentric lift, the user may eccentrically "lift" (i.e., lower) eighty pounds in total.

The motor 1112 includes a gearing mechanism and a clutch that allows movement only in one direction (e.g., in the movement that lifts the motor pole 1116 upward) while the clutch is active. The clutch and gears may prevent the motor pole 1116 from dropping due to gravity while the clutch is engaged. When the clutch is disengaged, the motor 1112 may allow the motor pole 1116 to drop. The motor 1112 may also omit a clutch and use a break or latch or other means to prevent the motor pole 1116 from dropping when the user is still concentrically lifting the user pole 1114. As shown in FIG. 11, the motor 1112 may be located on the bottom of the eccentric weightlifting machine's frame 1110.

Figure 12:
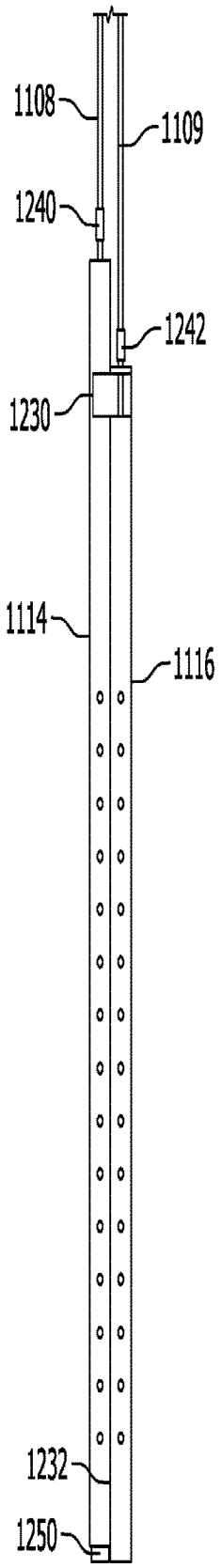
FIG. 12 illustrates a rear elevational view of a first weightlifting pole and a second weightlifting pole of the eccentric weightlifting machine according to another exemplary embodiment.

Referring to FIG. 12, the user pole 1114 is adjacent to the motor pole 1116. A first sensor 1230 may be mounted on the user pole 1114. A second sensor 1232 may be mounted where a latch 1250 contacts the motor pole 1116. The first sensor 1230 may be mounted anywhere on the user pole 1114 above the holes where the pin 1118 or 1120, shown in FIG. 11, is inserted, such as in between the user pole 1114 and the motor pole 1116. The first sensor 1230 may detect when the motor pole 1116 touches the first sensor 1230 and when the motor pole 1116 is not touching the first sensor 1230. The first sensor 1230 may also detect when the eccentric weightlifting machine 1100 is being used or not used. The second sensor 1232 may detect when the latch 1250 is latched to the motor pole 1116. The first sensor 1230 and the second sensor 1232 may be contact sensors, roller level micro-switches, piezoelectric sensors, or any type of sensors configured to detect contact with either the motor pole 1116 when the latch 1250 is latched to the motor pole 1116.

The user pole 1114 and the motor pole 1116 each include a first connection device 1242 and a second connection device 1240, respectively, connecting the user pole 1114 and the motor pole 1116 to one of the first cable 1108 or the second cable 1109. For example, the connection devices 1240, 1242 may be eye bolts, but any means of connecting a pole to a cable or the like may be used in the exemplary embodiments. A cable is described for illustration purposes only as connecting the bar 1104 and the user pole 1114 or the motor 112 and the motor pole 1116, and any mechanical connection between either the motor pole 1116 and the motor 1112 or the user pole 1114 and the bar 1104 may connect two components.

The latch 1250 may be located within the user pole 1114, which is hollow. The latch 1250 may extend outside of the user pole 1114 when the user pole 1114 is not in contact with the frame 1110 and the wall of the motor pole 1116 does not block the latch 1250 from entry into the motor pole 1116. In addition, the latch 1250 may retract within the user pole 1114 when the latch 1250 contacts the frame 1110.

Figure 13A:
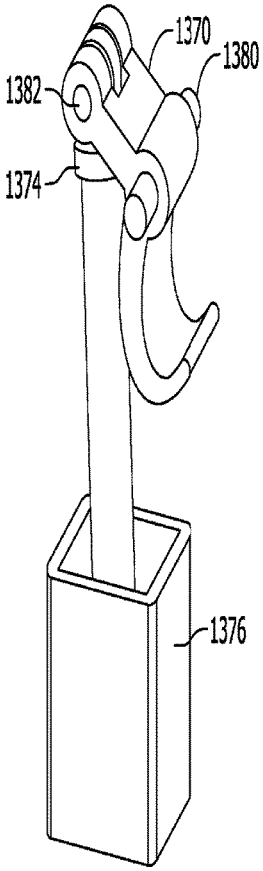
FIG. 13*a-c* illustrate a first latch mounted within the first weightlifting pole according to another exemplary embodiment.
Figure 13B:
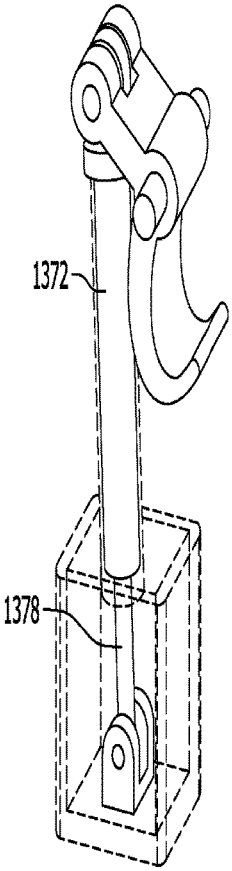
Figure 13C:
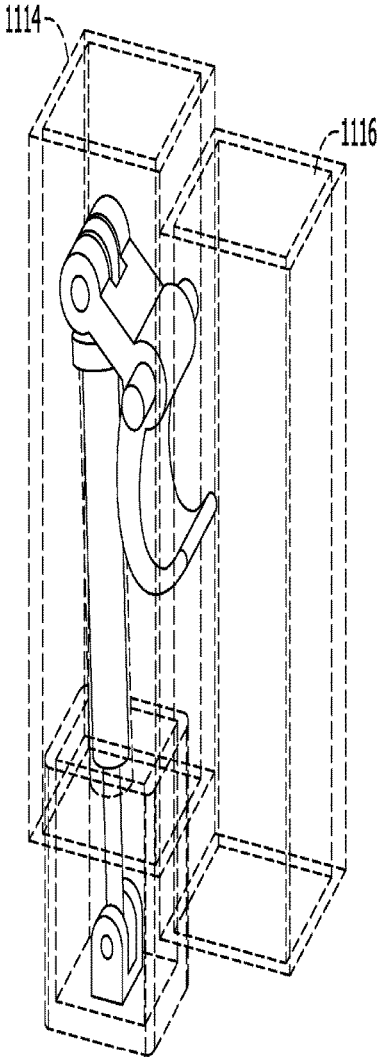

An example of the latch is illustrated in FIG. 13*a-c* and generally indicated by numeral 1250. FIG. 13*a* illustrates a completely opaque view of the latch 1250, FIG. 13*b* illustrates a transparent view of the latch 1250, and FIG. 13*c* illustrates the latch 1250 within the user pole 1114. As shown in FIG. 13, the latch 1250 includes seven main components, a hook 1370, a spring piston 1372, a cap 1374, a piston foot structure 1376, a connecting rod 1378, a first pin 1380, and a second pin 1382.

The hook 1370 includes two pivot axes, and the two pivot axes may receive the first and second pins 1380, 1382. The first pin 1380 connects the latch 1250 to the inner walls of the user pole 1114, and the second pin 1382 connects the hook 1370 to the cap 1374. Because the latch 1250 is connected to the user pole 1114 by the first pin 1380, the hook 1370 rotates about first pin 1380. The cap 1374 may include a bushing that connects to the back of the hook 1370.

The spring piston 1372 may be a steel spring that connects to the connecting rod 1378, and the connecting rod connects the spring piston 1372 to the piston foot structure 1376. The spring piston 1372 together with the connecting rod 1378 and the piston foot structure 1376 cause the hook 1370 to retract from latching with the motor pole 1116 or allows the hook 1370 to latch with the motor pole 1116. When a force acts upon the piston foot structure 1376 from below, the piston foot structure 1376 retracts upward into the user pole 1114, which in turn causes the hook 1370 to retract into the user pole 1114, thereby preventing the hook 1370 from latching with the motor pole 1116. Such a force may be provided by the user pole 1114 contacting the frame 1110. When the force acting upon the piston foot structure 1376 is removed, the hook 1370 is free to pivot into the motor pole 1116 and latch the motor pole 1116 to the user pole 1114 if the walls of the motor pole 1116 do not block the hook 1370 from extending into the motor pole 1116. As shown in FIG. 13*c*, the motor pole 1116 includes a hole where the hook 1370 may extend into the motor pole 1116. Only when the motor 1112 brings the motor pole 1116 high enough is the hook 1370 able to extend into the hole in the side of the motor pole 1116. This process will be further explained below with reference to FIGS. 15-19.

Figure 13D:
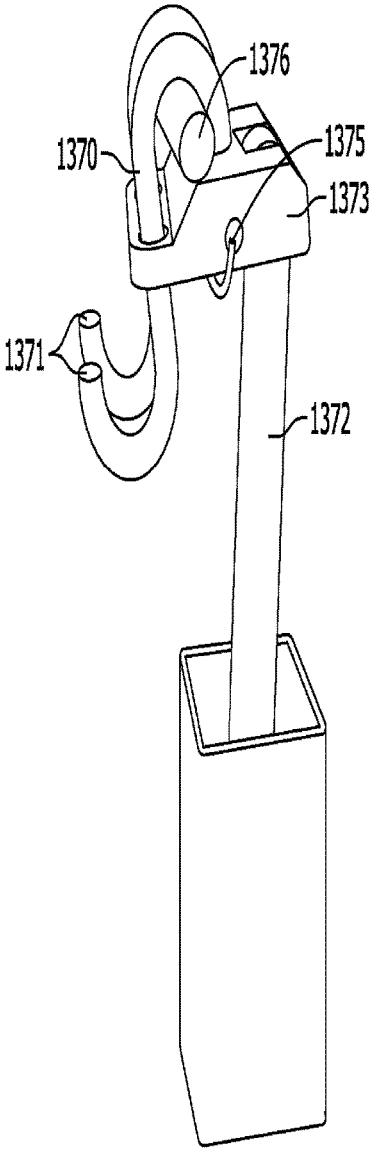
FIG. 13*d-e* illustrate a second latch mounted within the first weightlifting pole according to yet another exemplary embodiment.
Figure 13E:
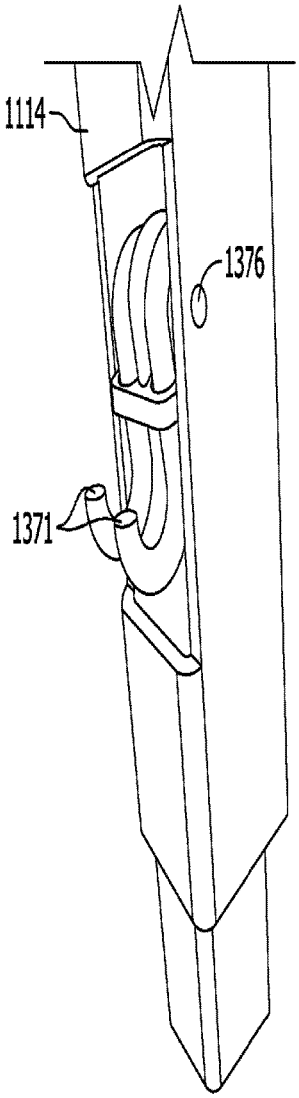

Similar to FIGS. 13*a-c*, FIGS. 13*d-e* illustrate a similar but alternate embodiment of the latch 1250. As shown in FIGS. 13*d-e*, the hook 1370 may be replaced with a double hook latch 1371 for cost saving purposes. Each double hook latch 1371 may be an "S" hook, which is a connector well-known in the art. The double hook latch 1371 may include 3-D printed plastic 1373 to hold together the two latches comprising the double hook latch 1371 and connect the double hook latch 1371 to the spring piston 1372. The double hook latch 1371 may be connected to the 3-D printed plastic 1373 through a pin 1375 but many other types of interconnections may suffice. In addition, the double hook latch 1371 may be positioned over a member 1376, e.g., pin, bolt, and so forth. The use of 3-D printed plastic saves time and cost in manufacturing a custom hook, like the hook 1370 illustrated in FIGS. 13*a-c*. Other than the double hook latch 1371 comprising two "S" hooks and 3-D printed plastic, the other components of the double hook latch 1371 illustrated in FIGS. 13*d-e* are the same as those illustrated and described with reference to FIG. 13*a-c*. FIG. 13*e* illustrates the double hook latch 1371 within the motor pole 1116.

Figure 14:
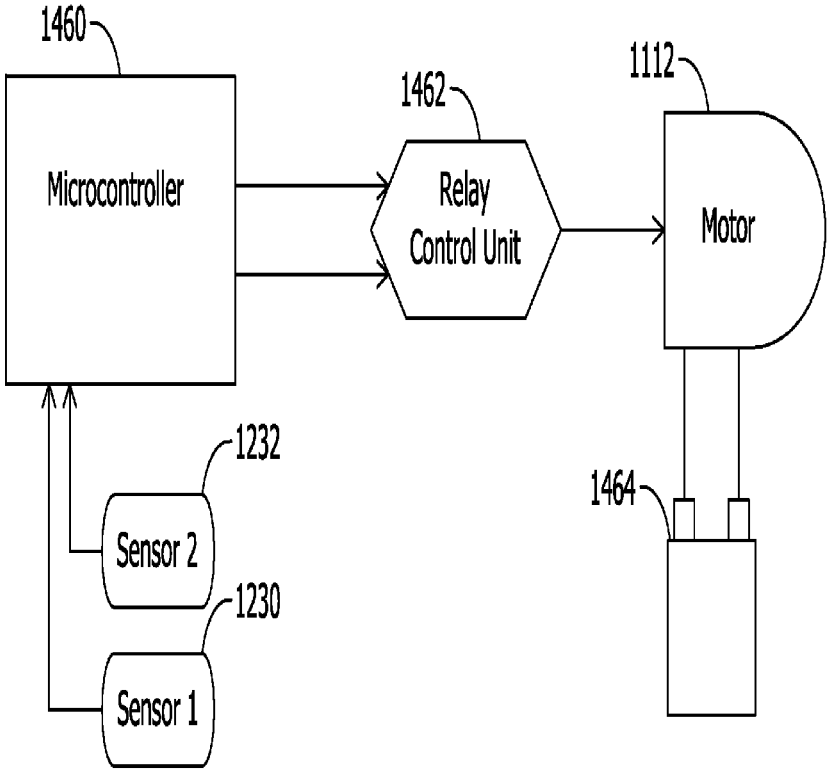
FIG. 14 illustrates a block diagram of the electronic components of the eccentric weightlifting machine according to another exemplary embodiment.

FIG. 14 illustrates the electrical configuration of the eccentric weightlifting machine 1100. The eccentric weightlifting machine 1100 includes a microcontroller 1460, the first and second, sensors 1230, 1232, a relay control unit 1462, the motor 1112, and a power supply 1464.

The microcontroller 1460 is connected to the two sensors 1230, 1232 and the relay control unit 1462. The microcontroller 1460 receives signals from the two sensors 1230, 1232 and interprets the signals in order to control the motor 1112. The microcontroller 1460 may be located anywhere on the weightlifting machine 1100. For example, the microcontroller 1460, the relay control unit 1462, and the power supply 1464 may all reside in a black box located near the motor 1112.

For example, the first sensor 1230 indicates whether the user is exerting any force on the user pole 1114. When the user is not exerting force on the user pole 1114, the first sensor 1230 remains in contact with the motor pole 1116, and when the user does exert force on the user pole 1114, the first sensor rises with the user pole 1114 and no longer contacts the motor pole 1116. The microcontroller 1460 uses the signals from the first sensor 1230 to decide whether to activate the motor 1112. When the first sensor 1230 sends a signal to the microcontroller 1460 indicating that it is no longer in contact with the motor pole 1116 at the beginning of a new weightlifting repetition, the microcontroller 1460 sends a signal to the relay control unit 1462 to instruct the motor 1112 to begin lifting the motor pole 1116.

The microcontroller 1460 also uses the signals from the first sensor 1230 to decide whether to activate or deactivate the motor 1112. When the first sensor 1230 sends a signal to the microcontroller 1460 indicating that it is again contacting with the motor pole 1116 after losing contact with the motor pole 1116, the microcontroller 1460 sends a signal to the relay control unit 1462 to instruct the motor 1112 to stop lifting the motor pole 1116. Whenever the microcontroller 1460 receives a signal from the first sensor 1230 indicating that it is not in contact with the motor pole 1116, and the microcontroller 1460 receives a signal from the second sensor 1232 that the user pole 1114 is not latched to the motor pole 1116, the microcontroller 1460 instructs the motor 1112 to engage the clutch (if previously disengaged) and lift the motor pole 1116.

The microcontroller 1460 uses the signals from the second sensor 1232 to decide whether to disengage the clutch. When the second sensor 1232 sends a signal to the microcontroller 1460 indicating that the user pole 1114 is latched to the motor pole 1116 and the eccentric phase has begun, the microcontroller 1460 sends a signal to the relay control unit 1462 to instruct the motor 1112 to stop and disengage the clutch so that the user may lower both the user pole 1114 and the motor pole 1116. In an embodiment, the second sensor 1232 may be located on the hook 1370, and the second sensor 1232 detects contact with the motor pole 1116, or the second sensor 1232 is located on the motor pole 1116, and the second sensor 1232 detects contact with the latch 1250. The microcontroller 1460 also uses the signals from the second sensor 1232 to determine when the eccentric phase is over. While the latch 1250 locks the motor pole 1116 to the user pole 1114, the second sensor 1232 remains activated. Only after the latch 1250 becomes unlatched does the second sensor 1232 become inactive. Thus, the microcontroller 1460 uses the signal from the second sensor 1232 to determine when the eccentric phase begins and ends.

The relay control unit 1462 converts the digital signals sent from the microcontroller 1460 into analog signals understood by the motor 1112.

The power supply 1464 is connected to the motor 1112 to power the motor 1112. Although not illustrated, the power supply 1464 may also provide electrical power to the relay control unit 1462 and the microcontroller 1460. The power supply 1464 may be either a DC power source, such as a battery, or AC power source, such as a wall outlet, or a combination of the two. The power supply 1464 may further include an AC to DC converter, if necessary. Any of a wide variety of computers and processors may be utilized for the microcontroller 1460. Moreover, any of a wide variety of input/output devices may be utilized for the relay control unit 1462 and may be incorporated in the microcontroller 1460 rather than being a separate physical item.

FIGS. 15-19 illustrate the various phases of a weightlift and how the eccentric weightlifting machine functions during each phase. During an initial phase illustrated in FIGS. 15*a* and 15*b*, the user may position the first pin 1118 in the weight stack 1106. In the example shown in FIGS. 15*a* and 15*b*, the user has inserted the first pin 1118 between the fourth and fifth weights in the weight stack 1106 (forty pounds) and the second pin 1120 between the eighth and ninth weights in the weight stack 1106 (an additional forty pounds). Because the user pole 1114, which is connected to forty pounds, is connected to the bar 1104, the user will concentrically lift forty pounds, and the motor 1112 will lift the additional 40 pounds connected to the motor pole 1116 while the user applies force to the bar 1104.

Figure 15A:
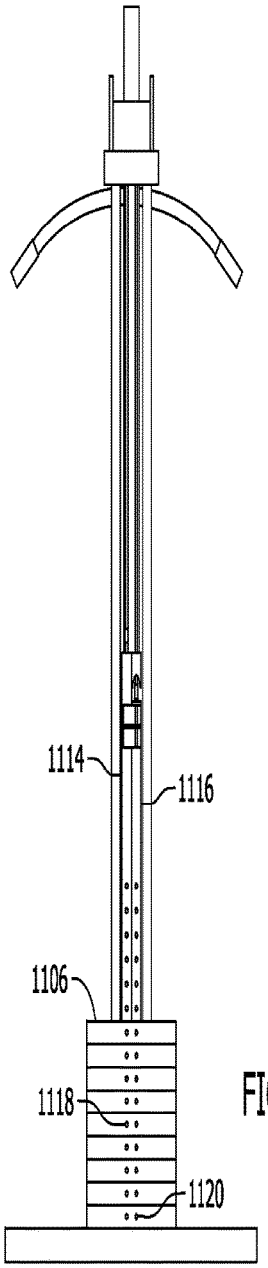
FIGS. 15-19 illustrates the function of the eccentric weightlifting machine during all phases of a lifting sequence according to another exemplary embodiment.
Figure 15B:
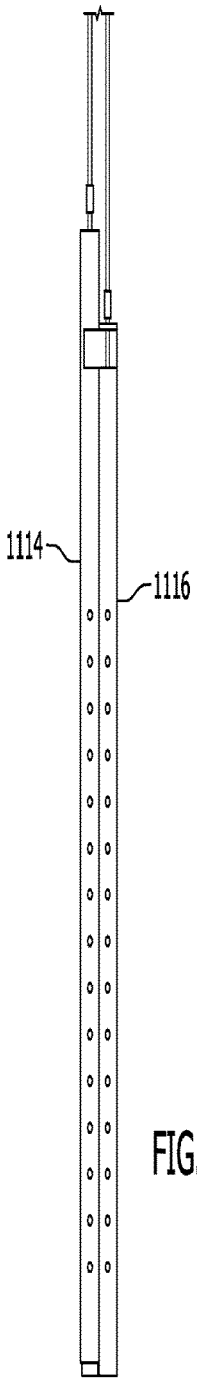
Figure 15C:
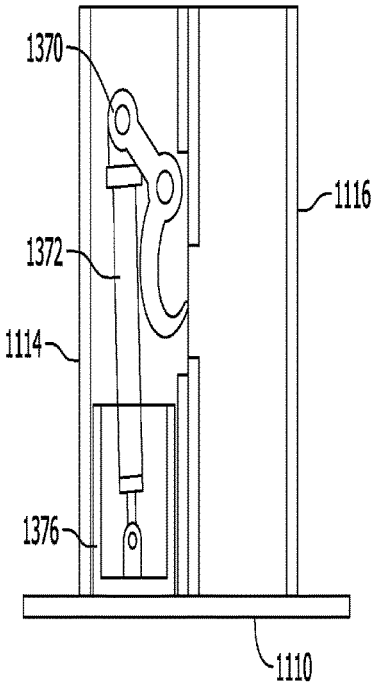

In addition, with reference to FIG. 15*c*, while gravity pulls on the user pole 1114 and the user does not apply sufficient force to lift the user pole 1114, the frame 1110 applies a force to the piston foot structure 1376, thereby compressing the spring piston 1372. The force applied by the frame 1110 causes the spring piston 1372 to apply a force on the hook 1370, thereby causing the hook 1370 to retract into the user pole 1114 and not latch to the motor pole 1116.

Figure 16A:
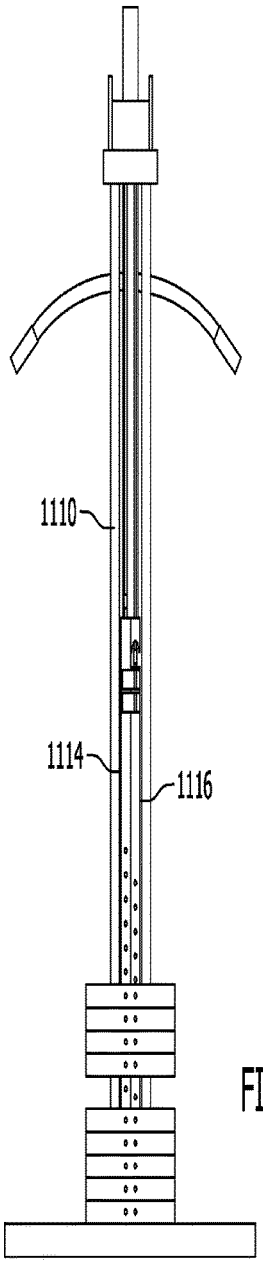
Figure 16B:
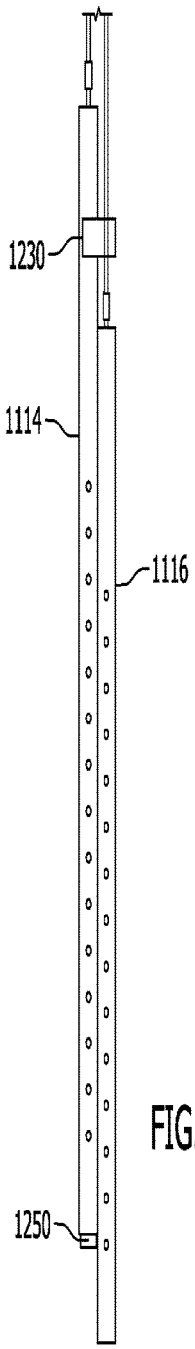
Figure 16C:
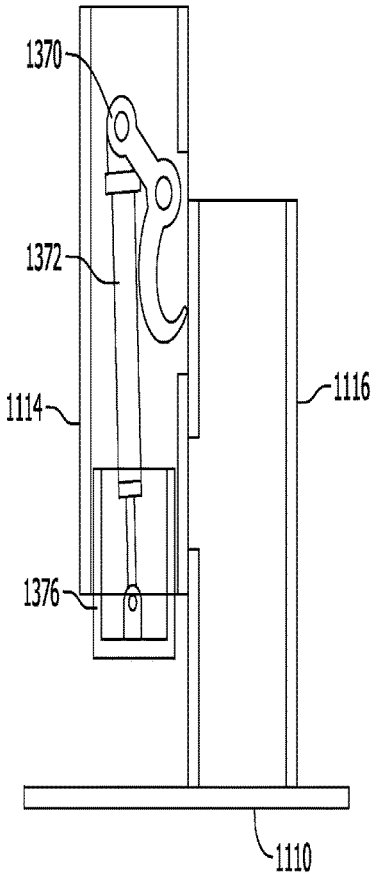
Figure 17A:
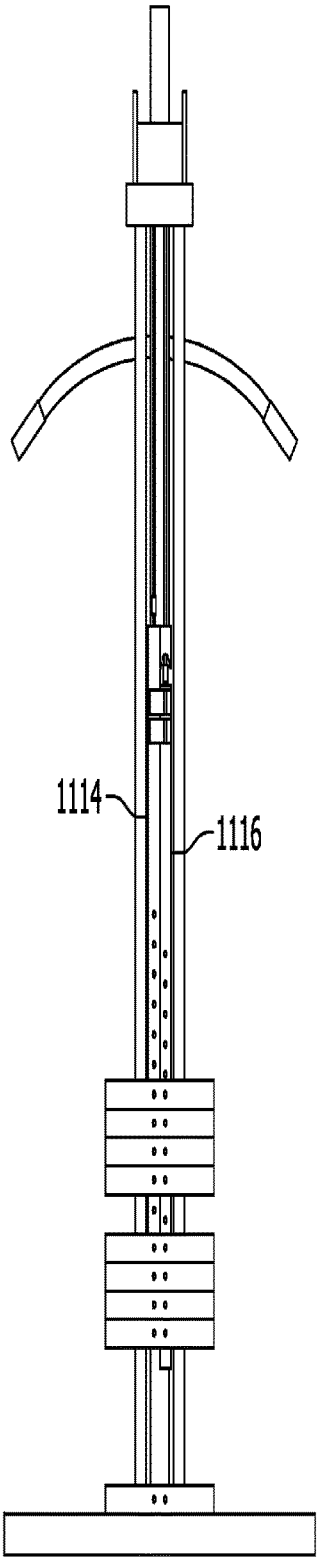
Figure 17B:
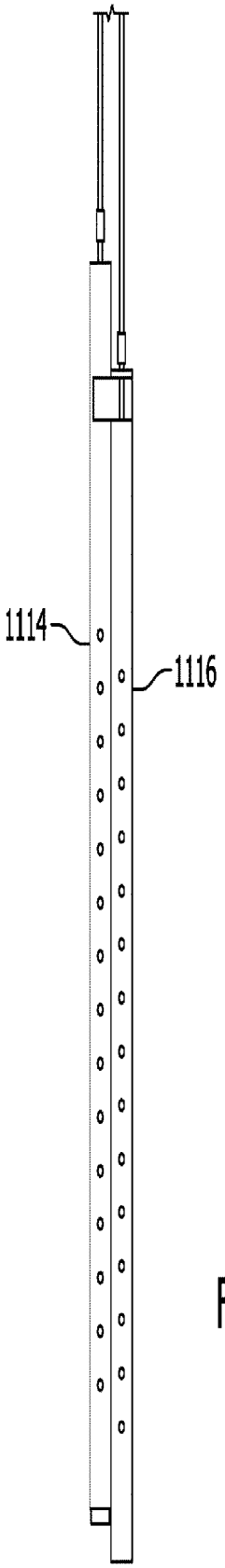

Referring now to FIGS. 16*a*, 16*b*, and 16*c* as well as the electronics in FIG. 14, while the user concentrically lifts the weight connected to the user pole 1114, the motor 1112 pulls up the motor pole 1116 in response to a signal from the first sensor 1230. When the first sensor 1230 detects that it is separated from the motor pole 1116 due to the user lifting the user pole 1114, the first sensor 1230 sends a signal to a microcontroller 1460, and the microcontroller 1460 interprets the message and instructs the motor 1112 to engage the clutch (if disengaged) and begin lifting the motor pole 1116. The motor 1112 continues to lift the motor pole 1116 until the motor pole 1116 again contacts the first sensor 1230 as shown in FIGS. 17*a* and 17*b* as well as FIG. 14. If the microcontroller 1460 later detects that the first sensor 1230 is no longer touching the motor pole 1116 and the second sensor 1232 detects that the user pole 1114 is not latched to the motor pole 1116 (for example if the user lifted the user pole 1114, stopped, and continued concentrically lifting), the microcontroller 1460 again instructs the motor 1112 to continue lifting the motor pole 1116 until the microcontroller 1460 receives a signal from the first sensor 1230 indicating contact with the motor pole 1116.

With reference to FIG. 16*c*, when the user begins to lift the user pole 1114, the piston foot structure 1376 extends downward as the spring piston 1372 decompresses. At this stage, the hook 1370 does not latch to the motor pole 1116 however, because the outer wall of the motor pole 1116 blocks any further outward extension of the hook 1370.

Figure 18A:
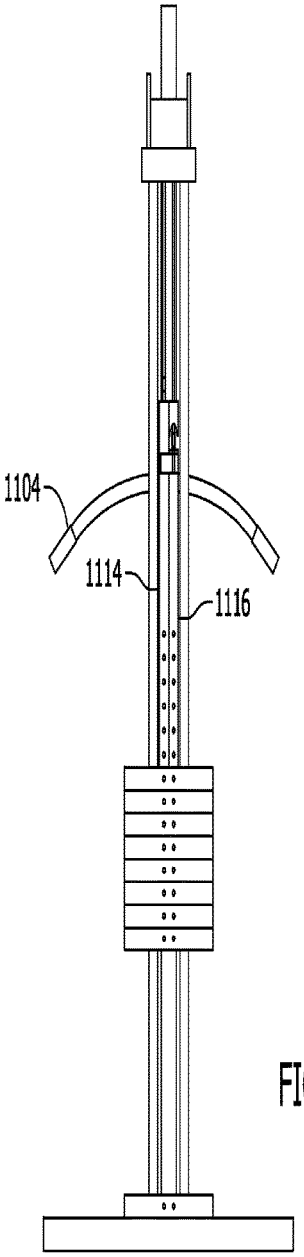
Figure 18B:
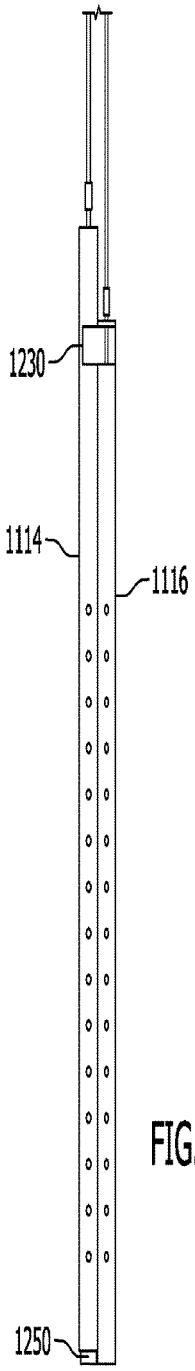
Figure 18C:
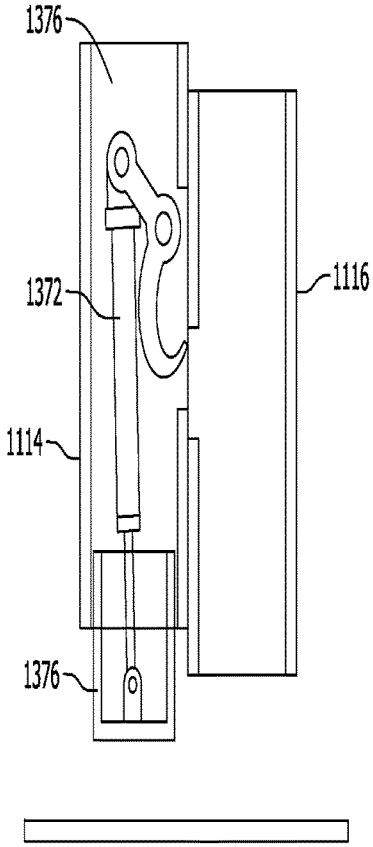

Referring now to FIGS. 18*a*, 18*b*, and 18*c*, after the user completes the concentric lift, the user begins the eccentric lift and begins to lower the bar 1104. Referring to FIG. 18*c*, as soon as the concentric phase ends, the latch 1250 latches the user pole 1114 to the motor pole 1116. When the user pole 1114 latches to the motor pole 1116, the hook 1370 is able to extend into the opening of the motor pole 1116. When the hook 1370 reaches the opening in the motor pole 1116, the hook 1370 extends into the motor pole 1116 due to the leverage on the hook 1370 caused by gravity on the piston foot structure 1376 and the force of the spring piston 1372. By latching the user pole 1114 to the motor pole 1116, the user bears all eighty pounds. Thus, the user eccentrically lifts more weight than during the concentric lift.

When the latch 1250 latches the user pole 1114 to the motor pole 1116, the second sensor 1232 is activated indicating that the motor pole 1116 is latched to the user pole 1114. The microcontroller 1460 uses the signal from the second sensor 1232 to identify when the eccentric portion of the lift begins and ends. Upon receiving the signal from the second sensor 1232, the microcontroller 1460 instructs the motor 1112 to release the clutch so that the weight connected with the motor pole 1116 may lower.

Figure 19A:
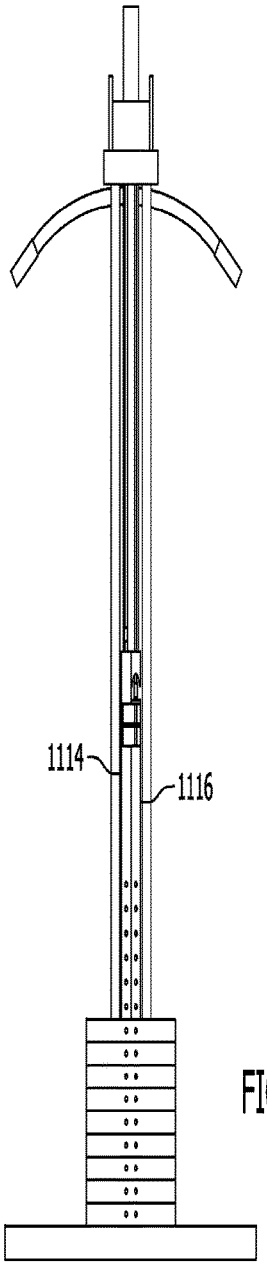
Figure 19B:
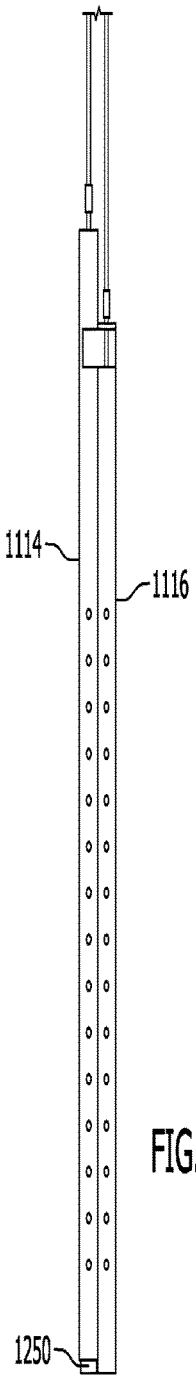
Figure 19C:
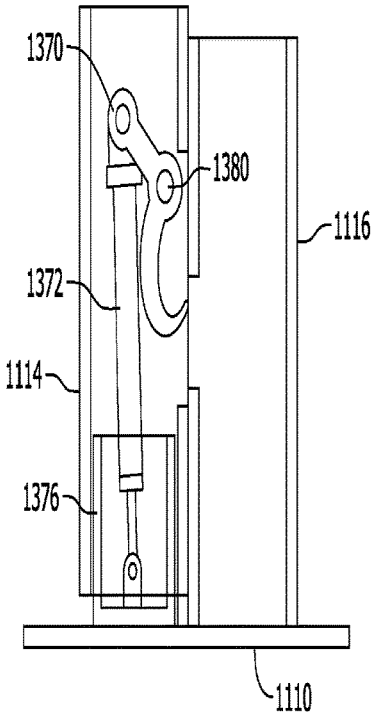

The microcontroller 1460 continues to receive a signal from the second sensor 1232 that the latch 1250 is engaged until the user pole 1114 is brought down far enough that the latch 1250 is unlatched. Referring to FIG. 19*c*, the latch 1250 becomes unlatched as the frame 1110 again applies a force to the piston foot structure 1376, thereby compressing the spring piston 1372 and pushing upward on the hook 1370. The upward leverage on the hook 1370 pushes the hook 1370 such that the hook 1370 retracts completely into the user pole 1114 by rotating about the first pin 1380, and the hook 1370 unlatches from the motor pole 1116. Referring to FIGS. 19*a* and 19*b*, the weight stack 1106 is brought down to the original position or nearly to the original position. The user may either finish the set or begin another repetition. If the user begins another repetition, the user will again concentrically lift less weight, e.g., forty (40) pounds.

Figure 20:
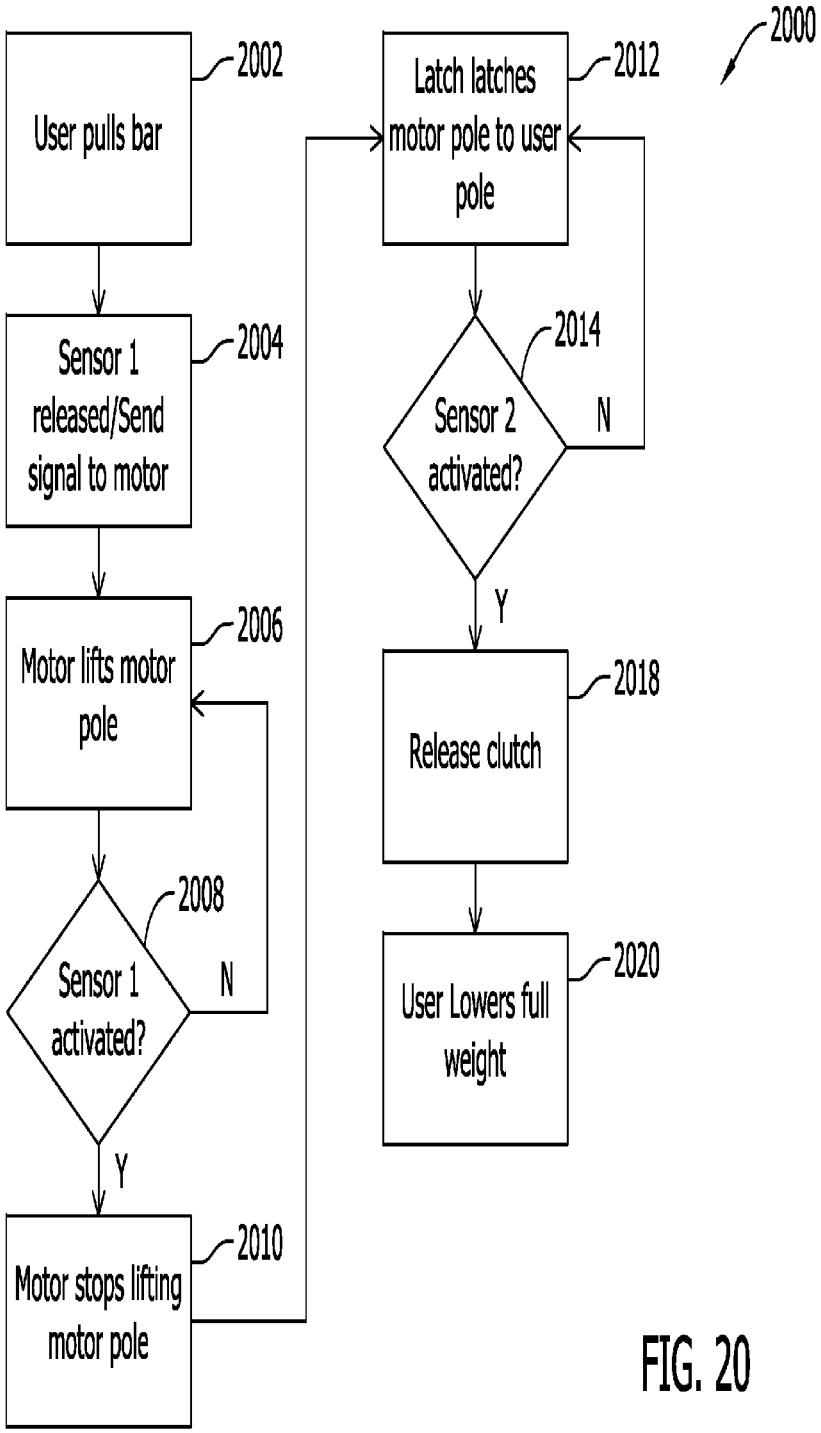
FIG. 20 illustrates a block diagram for the method of the eccentric weightlifting machine according to another exemplary embodiment.

FIG. 20 illustrates a method 2000 for how the eccentric weightlifting machine 1100 operates. In the description of the flowcharts, the functional explanation marked with numerals in angle braces, <nnn>, will refer to the flowchart blocks bearing that number.

In step <2002>, a user pulls the bar 1104 to being the concentric phase of the lift. In response to the user pulling the bar 1104, the user pole 1114 begins to rise. When the user pole 1114 rises, the first sensor 1230 separates from the motor pole 1116, and the first sensor 1230 sends a deactivated signal to the microcontroller 1460 indicating that it is separated from the motor pole 1116 in step <2004>. Upon receiving this signal from first sensor 1230, the microcontroller 1460 instructs the motor 1112 to begin lifting the motor pole 1116 in step <2006>. The microcontroller 1460 subsequently determines if the first sensor 1230 is activated in step <2008>, and the microcontroller 1460 continues to instruct the motor 1112 to lift the motor pole 1116 until the first sensor 1230 touches the motor pole 1116. The motor 1112 may lift the motor pole 1116 at a quick but not rapid pace. A user may configure the motor 1112 to lift slower or faster based on his typical lifting speeds.

When the first sensor 1230 touches the motor pole 1116, the microcontroller 1460 commands the motor 1112 to stop lifting the motor pole 1116 in step <2010>. Subsequently, the latch 1250 latches the user pole 1114 to the motor pole 1116 in step <2012>. The microcontroller 1460 determines whether the latch 1250 is engaged by monitoring the second sensor 1232 in step <2014>. If the second sensor 1232 is not activated, the microcontroller 1460 continues to wait until the second sensor 1232 sends a signal and the clutch of the motor 1112 holds the weight. If the second sensor 1232 is activated, the microcontroller 1460 commands the motor 1112 to release the clutch in step <2018> to allow the user to eccentrically lower the weight connected to the user pole 1114 and the motor pole 1116 in step <2020>.

Figure 21:
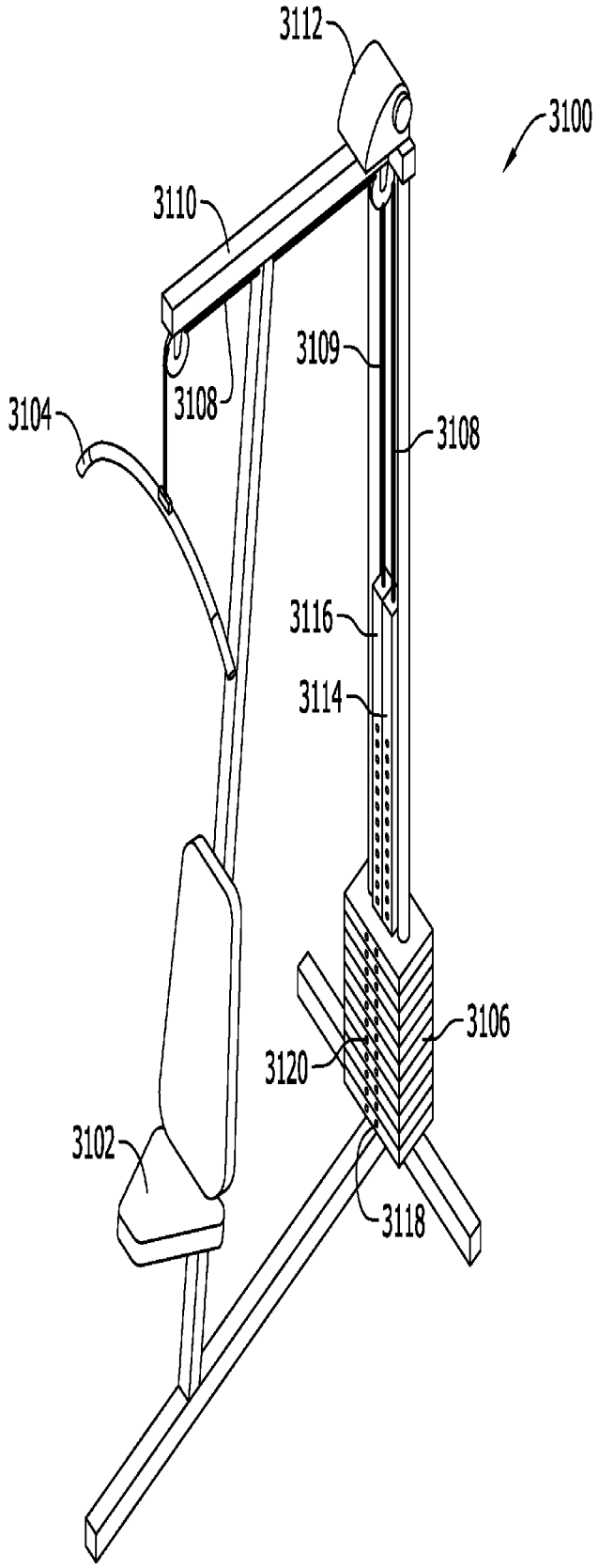
FIG. 21 illustrates an eccentric weightlifting exercise machine according to the exemplary embodiment shown in FIG. 20.

Referring to FIG. 21, an eccentric weightlifting machine according to a third embodiment 3100, may have a seat 3102, a bar 3104, and a weight stack 3106. FIG. 21 illustrates that the bar 3104 connects to the weight stack 3106 through a first cable 3108 over a frame 3110; however, the embodiments shown herein are not limited to a weightlifting machine having this configuration.

In addition to the conventional components recited above, the eccentric weightlifting machine 3100 includes a motor 3112 and two weightlifting poles, i.e., a user pole 3114 and a motor pole 3116. The user pole 3114 connects to the bar 3104 through the first cable 3108 such that, when a user pulls on the bar 3104 with sufficient force, the user pole 3114 rises. The user pole 3114 may connect to the weight stack 3106 through a first pin 3118. The user chooses an amount of weight to concentrically lift when placing the first pin 3118 in the weight stack 3106 and user pole 3114. The motor pole 3116 connects to the motor 3112 through a second cable 3109 such that, when the motor 3112 activates, the motor pole 3116 rises. The motor pole 3116 connects to the weight stack 3106 through a second pin 3120 in a similar way as the first pin 3118. As shown in FIG. 21, the weight stack 3106 includes two sets of holes corresponding to the two poles, i.e., a user pole 3114 and a motor pole 3116. Preferably, the second pin 3120 is inserted into the weight stack 3106 at a position lower than the first pin 3118 so that the motor 3112 lifts weights from the weight stack 3106 in addition to the weights from the weight stack 3106 lifted by the user using the user bar 1104. For illustration purposes only in FIG. 21, the first pin 3118 is placed between the fourth and fifth weights in the weight stack 3106, which may equate the forty pounds, and the second pin 3120 is placed between the eighth and ninth weights in the weight stack, which may equate to another forty pounds, or eighty pounds in total. According to FIG. 21 and through the exemplary embodiments described herein for illustration purposes, the user may concentrically lift forty pounds while the motor may lift another forty pounds, and after the concentric lift, the user may eccentrically "lift" (i.e., lower) eighty pounds in total.

The motor 3112 includes a gearing mechanism and a clutch that allows movement only in one direction (e.g., in the movement that lifts the motor pole 3116 upward) while the clutch is active. The clutch and gears may prevent the motor pole 3116 from dropping due to gravity while the clutch is engaged. When the clutch is disengaged, the motor 3112 may allow the motor pole 3116 to drop. The motor 3112 may also omit a clutch and use a break or latch or other means to prevent the motor pole 3116 from dropping when the user is still concentrically lifting the user pole 3114. As shown in FIG. 21, the motor 3112 may be located on the eccentric weightlifting machine's frame 3110 or elsewhere, e.g., floor, with the use of a pulley (not shown).

Figure 22:
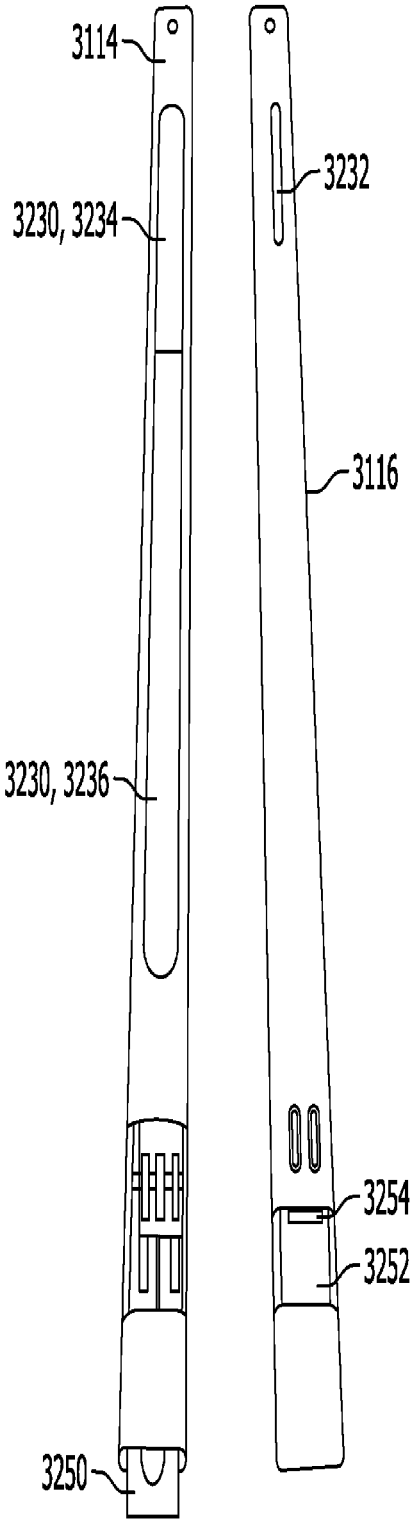
FIG. 22 illustrates a rear elevational view of a first weightlifting pole and a second weightlifting pole to the eccentric weightlifting machine according to the exemplary embodiment shown in FIG. 20.

Referring to FIGS. 21-22, the user pole 3114 is adjacent to the motor pole 3116. A portion 3230 may be located on the user pole 3114 and a linear sensor array 3232 may be located on the motor pole 3116. In this illustrative, but nonlimiting, embodiment, the linear sensor array 3232 comprises approximately eight infrared sensors. It is to be understood, however, that there can be more than eight sensors or less than eight sensors used. It is also to be understood that sensors other than infrared sensors could also be used. The linear sensor array 3232 may be located towards the top of the motor pole 3116. The sensors within the linear sensor array 3232 are adapted to detect color variations. The sensors within the linear sensor array 3232 are adapted to send various signals to the motor 3112 depending upon the detected color. In the configuration shown in FIG. 22, the sensors within the linear sensor array 3232 are adapted to detect the sensor position reference portion 3230. The sensor position reference portion 3230 on the user pole 3114 comprises a dark section 3234 and a light section 3236. As the user pole 3114 is raised during operation of the eccentric weightlifting machine 3100, the linear sensor array 3232 is able to detect this movement as a result of the sensor position reference portion 3230.

When the eccentric weightlifting machine 3100 is in a state of rest, the user pole 3114 and the motor pole 3116 are oriented in a manner such that the linear sensor array 3232 detects only the dark section 3234 of the sensor position reference portion 3230. When a user concentrically lifts the weight connected to the user pole 3114 by moving the bar 3104, the user pole moves upwardly. As a result, the sensor position reference portion 3230 will also move upwardly such that at least some of the sensors within the linear sensor array 3232 will detect the light section 3236 of the sensor position reference portion. When at least some of the sensors within the linear sensor array 3232 detect the light section 3236 of the sensor position reference portion 3230, the linear sensor array will send a signal to a remote microcontroller 3238.

Figure 23:
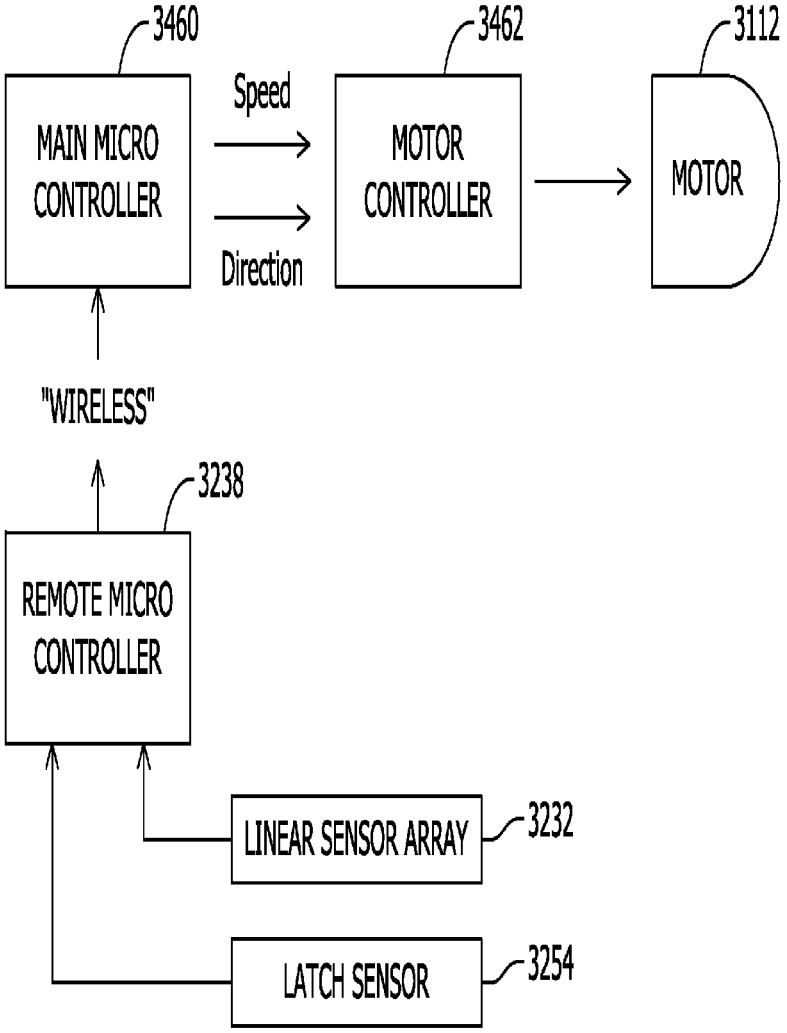
FIG. 23 illustrates a block diagram of the electronic components of the eccentric weightlifting machine according to the exemplary embodiment shown in FIG. 20.

As shown in FIG. 23, the remote microcontroller 3238 will then wirelessly transmit the signal to a main microcontroller 3460. The main microcontroller 3460 interprets and transmits the signal to a motor controller 3462. The main microcontroller 3460 and the motor controller 3462 instruct the motor 3112 to continue to lift the motor pole 3116 until all of the sensors within the linear sensor array 3232 detect the dark section 3234 of the sensor position reference portion 3230. It is to be understood that the eccentric weightlifting machine 3100 could be adjusted such that the linear sensor array 3232 will only send a signal to a remote microcontroller 3238 after all of the sensors within the linear sensor array detect the light section 3236 of the sensor position reference portion 3230.

The user pole 3114 comprises a latch 3250 that locks the user pole and the motor pole 3116 together while the user and motor poles are being lowered in an eccentric lift. The latch 3250 functions in a similar manner as the latch 250 described above. After completing the concentric lift, the user begins the eccentric lift. First, the user maneuvers the bar 3104 such that the user pole 3114 lowers slightly, allowing the latch 3250 to enter into an opening 3252 on the motor pole 3116. The opening 3252 comprises an electronic latch sensor 3254. After the latch 3250 enters the opening 3252, the user pole 3114 is again lifted such that the latch engages the electronic latch sensor 3254. The electronic latch sensor 3254 sends a signal to the remote microcontroller 3238. As shown in FIG. 23, the remote microcontroller 3238 will then wirelessly transmit the signal to a main microcontroller 3460. The main microcontroller 3460 interprets and transmits the signal to a motor controller 3462. The motor controller 3462 then instructs the motor 3112 to begin lifting the motor pole 3116. The main microcontroller 3460 and the motor controller 3462 instruct the motor 3112 to reverse at a set speed such that as the user completes the eccentric lift, the weight attached to the motor pole 3116 is combined with the weight attached to the user pole 3114, thereby forcing the user to eccentrically lift the combined load. Once the eccentric lift is completed, the latch 3250 detaches from the motor pole 3116 in a manner similar to that described within the other embodiments. In view of the foregoing, it will be seen that the several advantages of the invention are achieved and attained.

Figure 24:
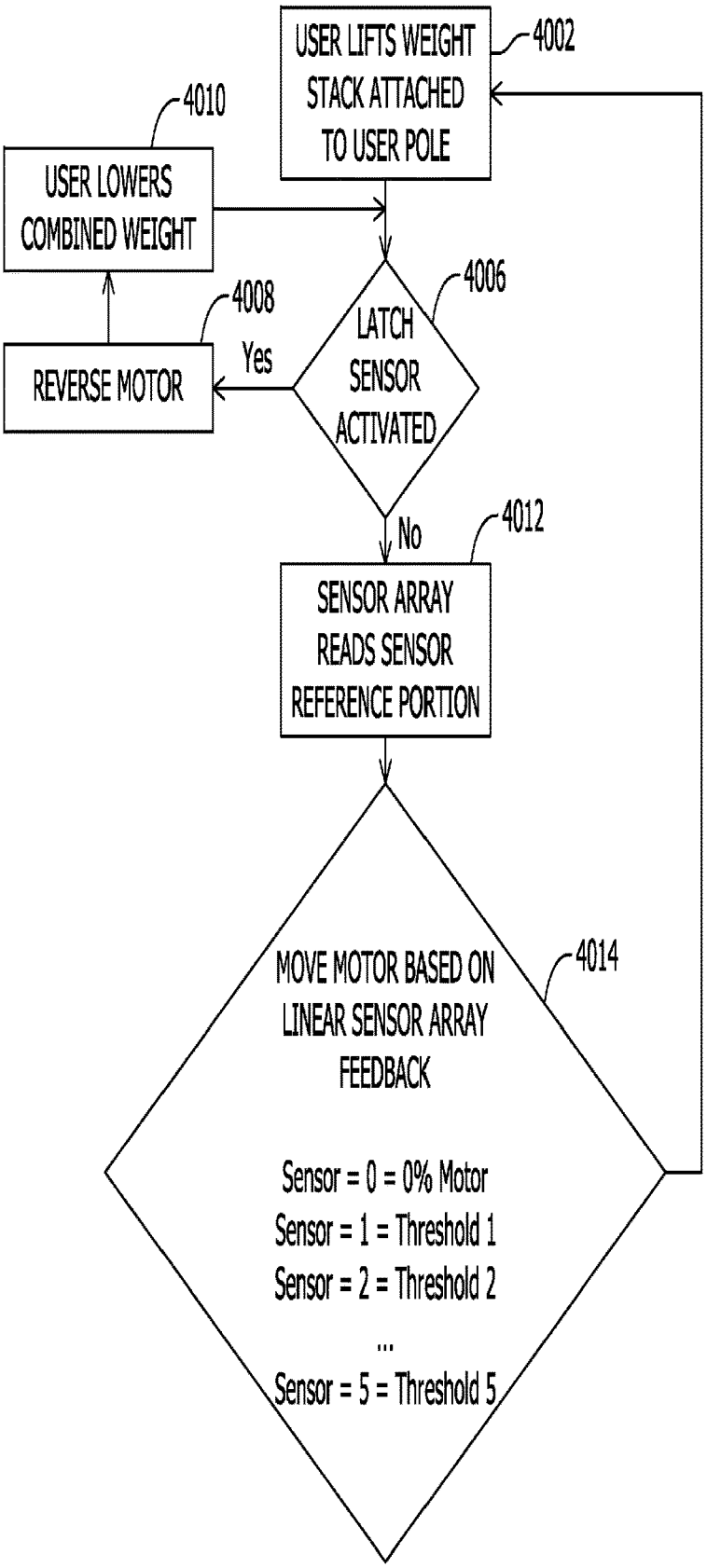
FIG. 24 illustrates a block diagram for the method of the eccentric weightlifting machine according to the exemplary embodiment shown in FIG. 20.

FIG. 24 illustrates a manner in which the eccentric weightlifting machine 3100 can operate. In the description of the flowcharts, the functional explanation marked with numerals in angle braces, <nnn>, will refer to the flowchart blocks bearing that number.

A user moves the bar 3104 to begin a concentric lift in step <4002>. This results in the user pole 3114 moving upward, thereby forcing the user to lift the weight stack 3106 attached to the user pole. During the concentric lift, a determination is made as to whether the electronic latch 3254 is activated in step <4006>. If the electronic latch sensor 3254 is not activated as the user pole 3114 moves upwardly, the sensor reference portion 3230 attached to the user pole 3114 moves upwardly. The sensor array 3232 attached to the motor pole 3116 reads the moving sensor reference portion 3230 in step <4012>. Depending upon the sensor array 3232 feedback in step <4014>, a signal will be sent to the motor 3112 instructing the motor to lift the motor pole 3116. By lifting the motor pole 3116, the motor 3112 moves the weight stack 3106 attached to the motor pole 3116. Thus, during a concentric lift, the user does not lift the weight stack 3106 attached to the motor pole 3116. When the user begins an eccentric lift in a manner as described above, the latch 3250 will engage the electronic latch sensor 3254, thereby "activating" the electronic latch sensor in step <4006>. When this occurs, a signal will be to the motor 3112 to reverse its direction in step <4008>. Thus, rather than moving the motor pole 3116 upwardly, the motor pole will be moved downwardly. This results in the weight stack 3106 attached to the motor pole 3116 being combined with the weight stack attached to the user pole 3114 such that during the eccentric lift, the user must lift the entirety of the weight stack in step <4010>.

The embodiments were chosen and described in order to best explain the principles of the invention and its practical application to thereby enable others skilled in the art to best utilize the invention in various embodiments and with various modifications as are suited to the particular use contemplated.

Furthermore, it should be understood that when introducing elements of the present invention in the claims or in the above description of the preferred embodiment of the invention, the terms "have," "having," "includes" and "including" and similar terms as used in the foregoing specification are used in the sense of "optional" or "may include" and not as "required." Similarly, the term "portion" should be construed as meaning some or all of the item or element that it qualifies.

Thus, there has been shown and described several embodiments of a novel invention. As is evident from the foregoing description, certain aspects of the present invention are not limited by the particular details of the examples illustrated herein, and it is therefore contemplated that other modifications and applications, or equivalents thereof, will occur to those skilled in the art. Many changes, modifications, variations and other uses and applications of the present construction will, however, become apparent to those skilled in the art after considering the specification and the accompanying drawings. All such changes, modifications, variations and other uses and applications which do not depart from the spirit and scope of the invention are deemed to be covered by the invention which is limited only by the claims that follow.

What is claimed is:

1. An eccentric weightlifting machine comprising:

a first pole and a second pole, the first pole being connected to a first weight and to a device acted on by a user, the second pole being connected to a second weight and to a motor, wherein the motor is adapted to lift the second pole in response to movement of the first pole by the user;

a latch configured to latch the first pole to the second pole during an eccentric exercise portion of a weightlift; and a cable, the cable being connected to a frame of the eccentric weightlifting machine and the latch, wherein the cable is configured to unlatch the latch when the cable is taut.

2. The eccentric weightlifting machine of claim 1, wherein the cable is connected to a top of the frame.

3. The eccentric weightlifting machine of claim 1, further comprising a first sensor mounted to the first pole, the first sensor being configured to detect when the second pole contacts the first sensor and generate a signal indicating contact with the second pole.

4. The eccentric weightlifting machine of claim 3, further comprising a second sensor mounted to the first pole above the first sensor, the second sensor being configured to detect when the second pole contacts the second sensor and generate a signal indicating contact with the second pole.

5. The eccentric weightlifting machine of claim 4, further comprising a third sensor mounted to the first pole, the third sensor being configured to detect when the third sensor is in contact with the frame and generate a signal indicating whether the third sensor is in contact with the frame.

6. The eccentric weightlifting machine of claim 5, further comprising a microcontroller electrically connected to the motor and the first, second, and third sensors, wherein the microcontroller is configured to send a signal to the motor instructing the motor to lift the second pole in response to the microcontroller receiving the signal from the third sensor indicating that the third sensor is not in contact with the frame.

7. The eccentric weightlifting machine of claim 6, wherein the microcontroller is further configured to send a signal to the motor instructing the motor to stop lifting the first pole in response to the microcontroller receiving the signal from the first sensor indicating that the first sensor is contacting the second pole.

8. The eccentric weightlifting machine of claim 7, wherein the microcontroller is further configured to send a signal to the motor instructing the motor to release a clutch within the motor in response to the microcontroller receiving the signal from the second sensor indicating that the second pole is contacting the second sensor.

9. The eccentric weightlifting machine of claim 6, wherein the microcontroller sends a signal to the motor through a relay control unit configured to convert digital signals from the microcontroller into an analog signal sent to the motor.

10. The eccentric weightlifting machine of claim 3, further comprising a second sensor configured to detect when the first pole is latched to the second pole by the latch.

11. The eccentric weightlifting machine of claim 10, further comprising a microcontroller electrically connected to the motor and the first and second sensors, wherein the microcontroller is configured to send a signal to the motor instructing the motor to lift the second pole in response to the microcontroller receiving the signal from the first sensor indicating that the first sensor is not in contact with the second pole.

12. The eccentric weightlifting machine of claim 11, wherein the microcontroller is further configured to send a signal to the motor instructing the motor to stop lifting the second pole in response to the microcontroller receiving the signal from the first sensor indicating that the first sensor is contacting the second pole.

13. The eccentric weightlifting machine of claim 12, wherein the microcontroller is further configured to send a signal to the motor instructing the motor to release a clutch within the motor in response to the microcontroller receiving the signal from the second sensor indicating that the first pole is latched to the second pole.

14. The eccentric weightlifting machine of claim 1, wherein the motor is an electric motor.

15. The eccentric weightlifting machine of claim 1, wherein the latch is a gate latch.

16. The eccentric weightlifting machine of claim 1, wherein the latch includes a spring piston, a piston foot structure, and a hook, and wherein the hook latches the second pole to the first pole when the piston foot structure is able to extend due to a force applied by the spring piston, and the hook is able to extend into an opening in a wall of the second pole.

17. The eccentric weightlifting machine of claim 16, wherein the latch is mounted to the first pole within a hollow cavity within the first pole.

18. The eccentric weightlifting machine of claim 16, wherein the hook comprises two "S" hooks connected to the spring piston.

19. The eccentric weightlifting machine of claim 18, wherein the spring piston includes 3-D printed plastic.

20. The eccentric weightlifting machine of claim 1, wherein the first weight is a first set of weights in a weight stack, and the second weight is a second set of weights in the weight stack.

21. The eccentric weightlifting machine of claim 1, wherein the first weight includes at least one weight in a plurality of weight stacks, and the second weight is at least one weight in the plurality of weight stacks.

22. The eccentric weightlifting machine of claim 21, wherein each weight within the plurality of weight stacks has two or more pin holes to accommodate connection to more than one pole of a weightlifting machine.

23. The eccentric weightlifting machine of claim 1, wherein the second pole comprises at least one sensor, the at least one sensor being adapted to detect movement of the first pole.

24. The eccentric weightlifting machine of claim 23, wherein the at least one sensor is an infrared sensor.

25. The eccentric weightlifting machine of claim 23 wherein the first pole comprises a sensor reference portion, the sensor reference portion being adapted such that the at least one sensor can detect movement of the first pole as a result of movement of the sensor reference portion.

26. A method of operating a weightlifting machine comprising:

receiving a signal indicative of movement by a first pole from a first sensor;

sending a command to a motor to lift a second pole connected to the motor;

receiving a signal indicative of contact between a second sensor and the second pole;

sending a command to the motor to cease lifting of the second pole in response to the signal from the second sensor;

receiving a signal from a third sensor mounted on the first pole above the second sensor indicative of contact between the third sensor and the second pole; and sending a command to the motor to release a clutch within the motor.

27. A method of operating a weightlifting machine comprising:

receiving a signal indicative of movement by a first pole from a first sensor;

sending a command to a motor to lift a second pole connected to the motor;

receiving a signal indicative of contact between the first sensor and the second pole;

sending a command to the motor to cease lifting of the second pole in response to the signal from the first sensor;

receiving a signal from a second sensor indicating that the second pole is latched to the first pole; and sending a command to the motor to release a clutch within the motor or run the motor in reverse.

28. A method of operating a weightlifting machine comprising:

receiving a first signal from a first sensor, the first signal being indicative of movement of a first pole;

sending a first command to a motor to lift a second pole, the second pole being connected to the motor, the first command being sent in response to the first signal;

receiving a second signal from the first sensor, the second signal being indicative that the first pole is stationary;

sending a second command to the motor to cease lifting the second pole, the second command being sent in response to the second signal;

receiving a third signal from a second sensor indicating that the second pole is latched to the first pole; and sending a third command to the motor to release a clutch within the motor, the third command being sent in response to the third signal.

* * * * *